US008251603B2

(12) United States Patent
Kott et al.

(10) Patent No.: US 8,251,603 B2
(45) Date of Patent: Aug. 28, 2012

(54) PRESSURE FED SQUEEGE APPLICATOR

(76) Inventors: John Kott, Foothill Ranch, CA (US); Kenneth Kott, Foothill Ranch, CA (US)

( * ) Notice: Subject to any disclaimer, the term of this patent is extended or adjusted under 35 U.S.C. 154(b) by 1128 days.

(21) Appl. No.: 12/039,469

(22) Filed: Feb. 28, 2008

(65) Prior Publication Data

US 2008/0226379 A1 Sep. 18, 2008

Related U.S. Application Data

(63) Continuation-in-part of application No. 11/716,799, filed on Mar. 12, 2007, now abandoned.

(51) Int. Cl.
*A46B 11/00* (2006.01)

(52) U.S. Cl. ..... 401/48; 401/188 R; 401/261; 401/266; 118/207

(58) Field of Classification Search ..... 401/48, 401/188 R, 261, 263, 265, 266; 118/108, 118/207, 305
See application file for complete search history.

(56) References Cited

U.S. PATENT DOCUMENTS

| | | | | |
|---|---|---|---|---|
| 3,232,585 | A | 2/1966 | Garbarino, Jr. et al. | |
| 3,921,901 | A | 11/1975 | Woodman | |
| 4,019,653 | A | 4/1977 | Scherer et al. | |
| 4,217,062 | A | 8/1980 | Trp et al. | |
| 4,431,307 | A | 2/1984 | Suovaniemi | |
| 4,583,876 | A | 4/1986 | Karliner et al. | |
| 4,692,048 | A | 9/1987 | Krohn et al. | |
| 4,776,716 | A * | 10/1988 | Huang | 401/139 |
| 4,789,100 | A | 12/1988 | Senf | |
| 4,998,672 | A | 3/1991 | Bordaz et al. | |
| 5,007,753 | A * | 4/1991 | England, Jr. | 401/139 |
| 5,271,682 | A * | 12/1993 | Realdon | 401/37 |
| 5,388,761 | A | 2/1995 | Langeman | |
| 6,065,890 | A * | 5/2000 | Weitz | 401/146 |
| 6,131,823 | A | 10/2000 | Langeman | |
| 6,203,183 | B1 | 3/2001 | Mordaunt et al. | |
| 6,330,731 | B1 | 12/2001 | Jackson et al. | |
| 6,331,327 | B1 | 12/2001 | Jackson et al. | |
| 6,533,189 | B2 | 3/2003 | Kott et al. | |
| 6,755,348 | B1 | 6/2004 | Langeman | |
| 6,962,455 | B2 * | 11/2005 | Kugler et al. | 401/48 |
| 7,025,286 | B1 | 4/2006 | Langeman | |
| 2007/0045289 | A1 | 3/2007 | Kott et al. | |
| 2007/0217856 | A1 | 9/2007 | Kott et al. | |

* cited by examiner

*Primary Examiner* — David Walczak
(74) *Attorney, Agent, or Firm* — Stetina Brunda Garred & Brucker; Lowell Anderson

(57) ABSTRACT

A squeegee apparatus for coating mixed materials on a surface is used in combination with a source of pressurized activator and resin in fluid communication with a mixing tube having an outlet. The squeegee apparatus includes a manifold in fluid communication with the outlet of the mixing tube. The squeegee is held by either the manifold or a handle. At least one distribution tube is provided to distribute the coated material, where the tube has a length with a plurality of holes to dispense the mixed materials during use. The distribution tube is fluid communication with the outlet of the mixing tube, with the distribution tube being fastened to the manifold. Moreover, an elongated squeegee is fastened to the manifold. The squeegee has an edge configured to spread the mixed materials during use. The distribution tube and the squeegee edge are aligned along substantially parallel axes and held in fixed relationship to each other by the manifold.

29 Claims, 15 Drawing Sheets

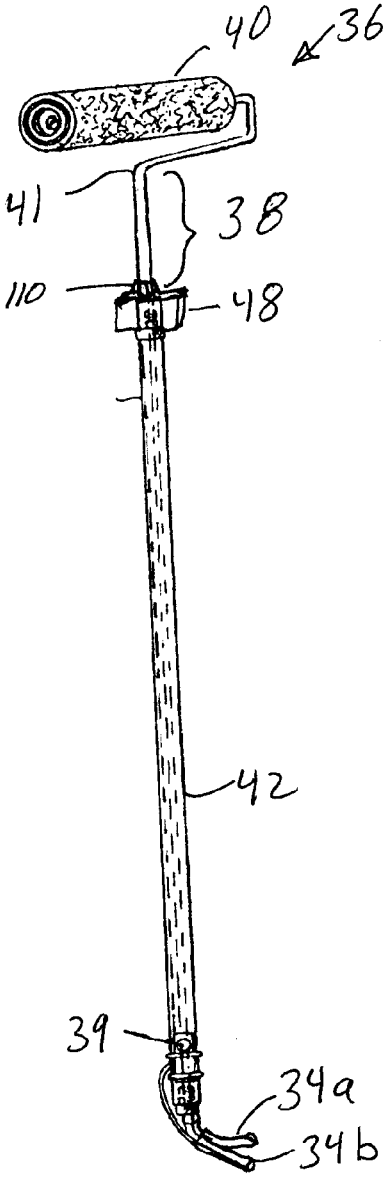
Fig. 8
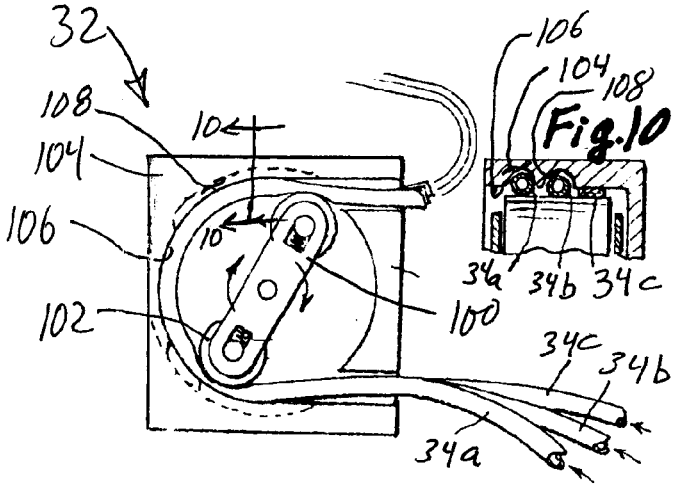
Fig. 9
Fig. 10

PRESSURE FED SQUEEGE APPLICATOR

RELATED APPLICATIONS

This application is a continuation in part of application Ser. No. 11/716,799, filed Mar. 12, 2007, now abandoned, the complete contents of which are incorporated herein by reference.

BACKGROUND

This invention relates to a method and apparatus for mixing multi-component products and applying them to a surface using a pressure fed squeegee.

Thick, viscous coating materials are sprayed onto building walls and other items to provide a thick elastomeric coating. The sprayed material is often a plural component urethane/polyurea material. But typical spraying application equipment requires a large source of air and high air pressure. Typical applications require minimum of 7 to 11 CFM at 250-3000 psi. This typically requires the use of a very large and heavy 220 volt air compressor usually weighing hundreds of pounds. Further, the performance of the material is very sensitive to temperature, so either large, heated rooms are typically needed in order to maintain the temperature of the materials at an operating temperature, or else high temperature heat sources are needed with smaller, enclosed areas.

Thinner and much less viscous materials are applied by spraying, but the operators must be carefully trained or else the thinner paint drips and provides an unacceptable aesthetic appearance. The thinner materials are thus commonly applied using paint rollers, with pressurized paint rollers being able to continually feed one or even two different paints to the roller. Such rollers are described in U.S. Pat. Nos. 4,217,062 and 6,331,327, among others. Paint rollers allow a more uniform thickness to be applied than with roller application. Also, rollers do not create the mist or roller cloud that arises when such thin paints are sprayed, and thus there is less masking and fewer environmental issues with roller application rather than roller applications. Moreover, significantly less training is needed for roller application of paint and the uneven application of paint causing dripping is much less common than with sprayed coatings.

But rollers have not been used with multi-part coatings which activate upon mixing. Such use is not logical since the activated coating materials remain on the roller and the roller will thus quickly harden. Moreover, the activated material in the feed mechanism also hardens and will clog if the material remains in the feed mechanism for more than a few minutes. Further, application of multi-part coatings by spray guns or by a roller leave a coating that can vary greatly in thickness within a given and have a rough, splotchy appearance. If the surface being coated is chipped, spalled or contains other recesses, then coating with rollers or spraying will not fill in the recesses further resulting in an uneven surface finish. There is thus a need for a method and apparatus allowing an improved uniform application of such multi-part coatings.

BRIEF SUMMARY

A portable coating system is provided having two containers of material in fluid communication with a material transfer line in fluid communication with a mixer tube that is connected to a pressure feed application device that preferably comprises a squeegee device, and less preferably comprises a roller. A motor powers two pumps that move the coating materials through the material lines to the pressure feed applicator. The static mixing tube is interposed between the material lines and the applicator in order to mix the plural components of the coating material right before the mixed materials are pressure fed through a distribution block and the squeegee or through a rolling element and rolled onto the surface being coated. A switch on the handle of the pressure feed roller allows an operator to start and stop the pumps to control the amount of material provided to the applicator and squeegee, or to the pressure feed roller. The switch is preferably electric. When coating is completed with the applicator and squeegee or roller, the static mixing tube is removed and discarded but the applicator, squeegee or roller are preferably cleaned with solvents for reuse. When coating is completed with the roller, the static mixing tube and rolling element are removed and discarded.

The material lines are preferably unheated, but could be wrapped with low power heaters to maintain the materials at a desirable operating temperature, while reducing power requirements. The material transfer lines can connect to inlet fittings on a manifold which combines the plural fluid inlets into a single outlet in fluid communication with the static mixing tube. The containers holding the materials are optionally provided with heaters, even individual, temperature controlled heaters, and preferably low power resistance heaters.

The applicator and squeegee, or the roller, can each fit into a portable cart sufficiently small that a single person can move the cart, and the cart can fit into an elevator. The entire roller application system preferably runs off of a single 110 volt standard power outlet in the U.S., or 220 volts overseas. Advantageously a power transformer automatically adjusts the input voltage to provide the correct voltage to the motor.

There is advantageously provided a portable system for application of a multi-part coating material to a surface using a squeegee. The system includes at least two containers for holding at least two coating materials. First and second material transfer lines connect the containers to a static mixing tube. A manifold is in fluid communication with the outlet of the static mixing tube and is in further fluid communication with distribution tubes extending from opposing sides of the manifold. The distribution tubes have openings through which the coating material is distributed onto the surface to be coated during use of the system. An elongated squeegee is fastened to either a handle or to the manifold. The distribution tubes are located to distribute coating material onto the surface to be coated and the squeegee is located to spread the material distributed from the distribution tubes. At least one pump is arranged to pump coating material from each container through the first and second transfer lines to the static mixing tube during use of the system and in response to a manually activated switch located on or adjacent to either the handle or the static mixing tube.

In further variations, the system includes a rolling cart holding the first and second containers. Advantageously a heater is placed in thermal communication with the at least two containers, with the heater providing sufficient heat to maintain the containers at a suitable operating temperature when coating material is placed in the containers during use of the system. The squeegee is preferably fastened to the handle with a swivel connection, and more preferably the handle is fastened to the manifold with a swivel connection. Ideally, the distribution tubes comprise two tubes releasably connected to the manifold and extending from the manifold along axes substantially parallel to an edge of the squeegee which abuts the surface to be coated. The openings in the distribution tubes are preferably located or shaped to distribute the coating material substantially uniformly along the length of the squeegee. The openings in the distribution tubes advantageously include openings facing the surface to be coated and also include openings at an angle to the surface to be coated. The openings in the distribution tubes could be of different size.

There is also provided a squeegee apparatus for use in applying a coating material to a surface. The apparatus includes an elongated squeegee having a length, with the squeegee being sized and configured to spread a premixed mixture of resin and activator before the mixture cures too much to be spread by the squeegee. The apparatus also includes a manifold having a fitting adapted to connect to a mixing tube that mixes a resin and activator. The manifold has sides and is in fluid communication with a distribution tube extending beyond each side. The distribution tube has plural openings to dispense material onto the surface being coated during use. The tube is aligned with the squeegee. A handle is connected to one of the manifold and squeegee, preferably to the manifold.

In further variations, the distribution tubes releasably fasten to the sides of the manifold and the manifold also has openings in fluid communication with the distribution tubes so the manifold openings can dispense material during use. Moreover, the squeegee is preferably releasably fastened to a post on the manifold. Ideally, a plurality of the openings in the distribution tubes open along an axis parallel to a plane containing the squeegee and a plurality of the openings in the distribution tubes open along an axis orthogonal to that plane.

There is also provided a squeegee apparatus for coating mixed materials on a surface in combination with a source of pressurized activator and resin in fluid communication with a mixing tube having an outlet. The squeegee apparatus includes a manifold in fluid communication with the outlet of the mixing tube. At least one distribution tube is provided, where the tube has a length with a plurality of holes to dispense the mixed materials during use. The distribution tube is fluid communication with the outlet of the mixing tube, with the distribution tube being fastened to the manifold. Moreover, an elongated squeegee is fastened to the manifold. The squeegee has an edge configured to spread the mixed materials during use. The distribution tube and the squeegee edge are aligned along substantially parallel axes and held in fixed relationship to each other by the manifold.

Moreover, the squeegee apparatus preferably includes a handle connected to the manifold. The handle has an electrical switch accessible from the handle by a user's hand holding the handle during use, the switch being electrically wired to activate the source of pressurized activator and resin during use. As above, there are optionally holes in the manifold that are in fluid communication with the outlet of the mixing tube during use, with the holes in the manifold located to dispense material directly onto the surface being coated during use. The source of pressurized activator and resin advantageously comprise 12V or 24V DC electric motors of under ¼ hp each.

There is also provided a method of applying mixed coating materials to a surface. The method includes pumping first and second materials from first and second containers to a mixing tube which mixes the materials. The mixed materials are distributed onto the surface along a length of a squeegee in a sufficiently uniform amount that the squeegee can spread the mixed materials in a substantially uniform layer.

The squeegee is draw across the mixed materials to spread the mixed materials and form a layer of the mixed materials. That basic method can also be varied to include a preliminary step of applying an adhesive to the surface and adhering a plurality of chips to the adhesive in sufficient amount to support the squeegee as it is drawn across the surface to form the layer. Further variations include back-rolling the layer. Additionally, the distributing step can optionally include passing the mixed materials through a manifold and tubes each of which has holes therein to distribute the mixed materials onto the surface. The tubes are preferably aligned along an axis parallel to a length of the squeegee, but could be along a line inclined to the length of the squeegee. Additionally, the squeegee can be mounted so it can rotate relative to the tubes and manifold, or the tubes and manifold can be mounted to rotate in fixed relationship to each other.

BRIEF DESCRIPTION OF THE DRAWINGS

These and other features and advantages of the various embodiments disclosed herein will be better understood with respect to the following description and drawings, in which like numbers refer to like parts throughout, and in which the roller embodiment is described first and the applicator and squeegee embodiment are described second, and in which:

FIG. 8 is a view of a further embodiment of a pressure feed roller, handle and static mixing tube;

FIG. 9 is a sectional view of a further embodiment of a pump;

FIG. 10 is a partial sectional view taken along 10-10 of FIG. 9;

DETAILED DESCRIPTION

Figure 1:
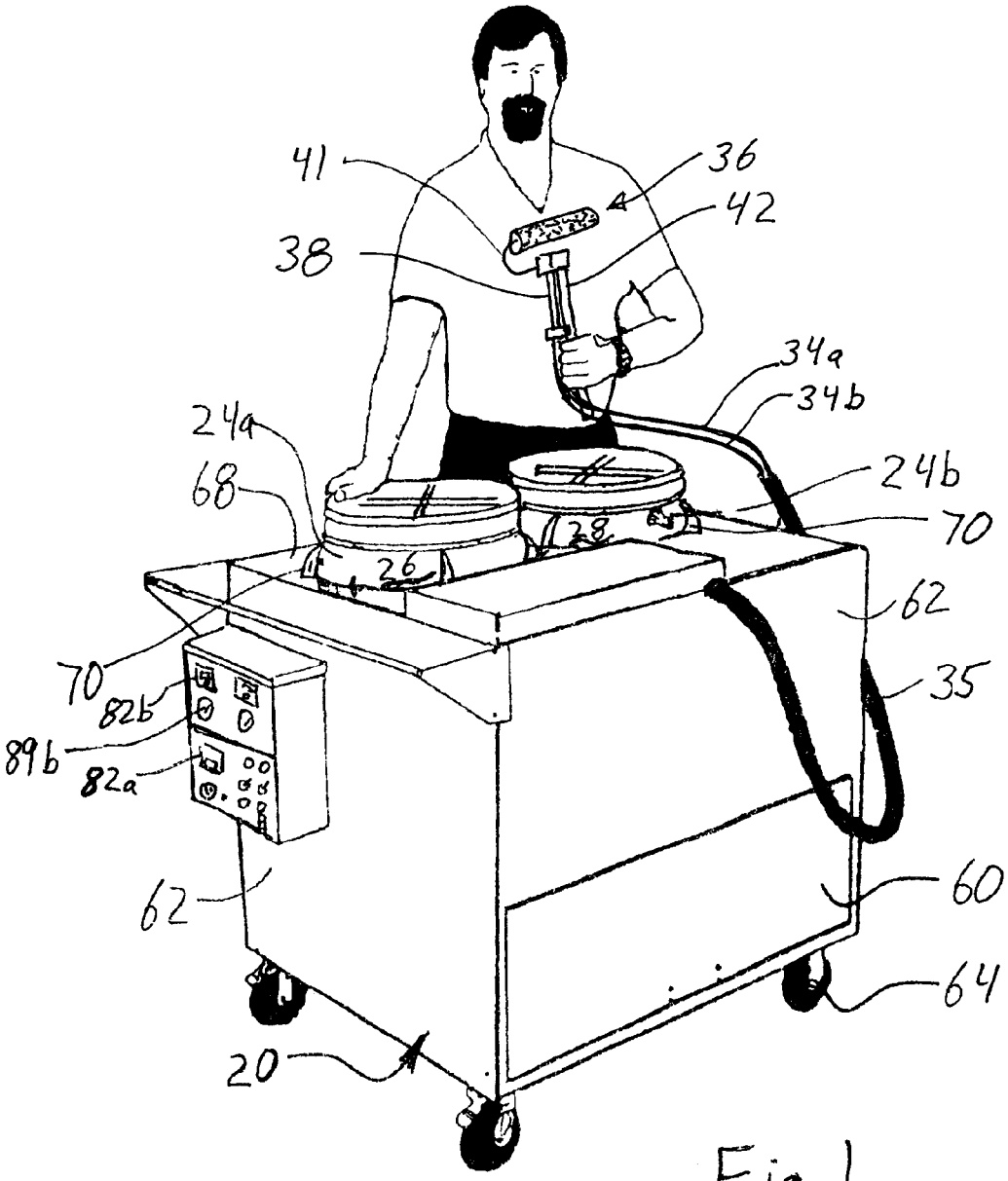
FIG. 1 is a schematic view of a roller system.
Figure 2:
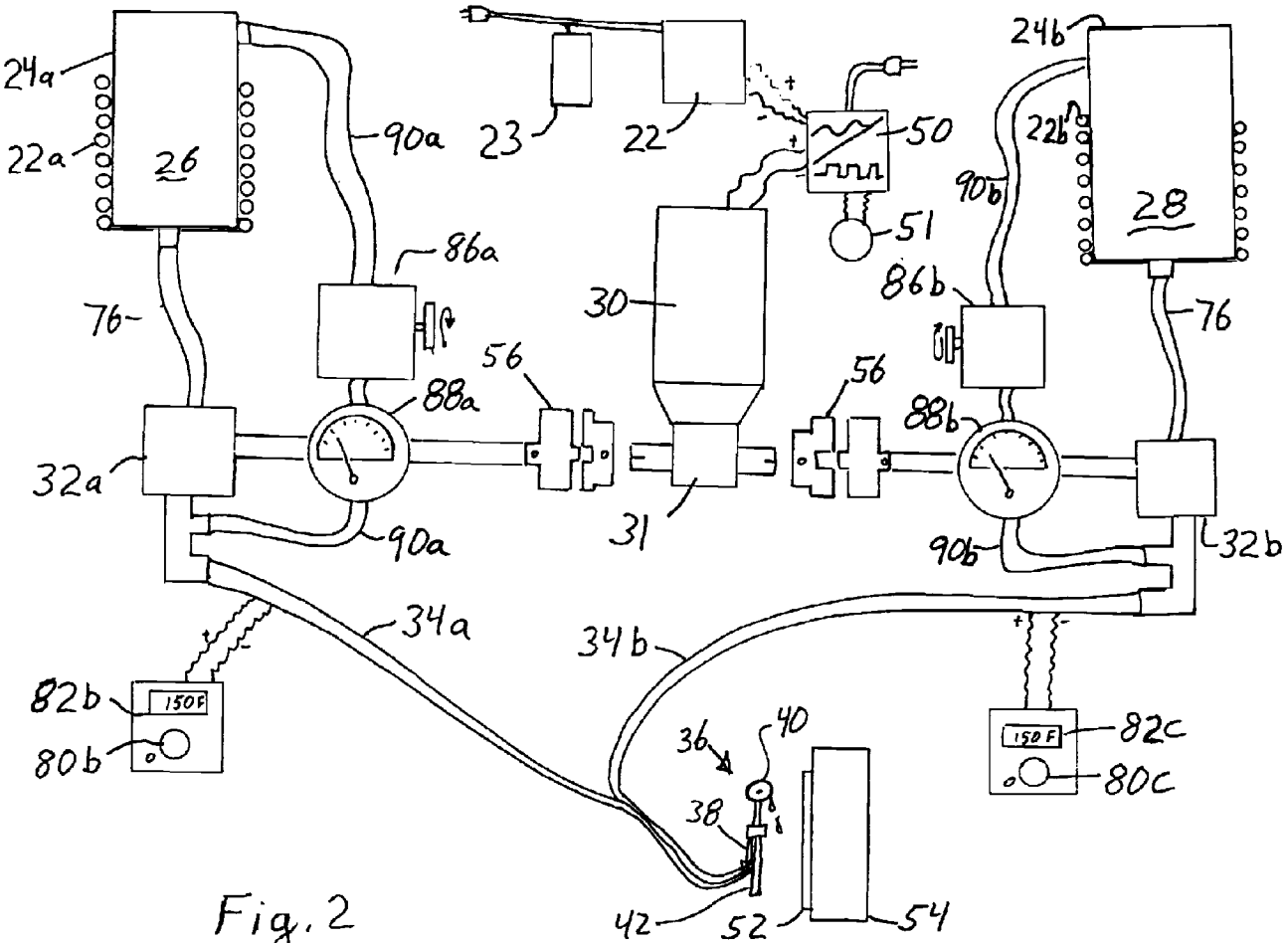
FIG. 2 is a schematic view of components used in the roller system of FIG. 1.

Referring to FIGS. 1-2, a portable roller system is shown that preferably, but optionally, has a portable cart 20 with a temperature controlled interior provided by an auxiliary heater 22 with an adjustable thermostat 23. The cart 20 can be omitted, but is preferred for portability reasons. One or more, and typically two containers or tanks 24 are mounted to the cart so the temperature of plural coating components can be maintained by the heater 22. There are preferably at least two tanks 24 containing plural materials for roller or squeegee application. Preferably one container 26 contains a urethane or resin and the other container contains an activator 28. But various types of plural component, catalyzed materials can be used, including urethanes, epoxies, enamels and acrylic materials. A single motor 30 drives appropriate pumps 32 through gear drives 31 to pump the materials 26, 28 through separate material lines 34*a*, 34*b* that are connected to a pressure feed roller 36. A peristaltic pump could also be used. A resistance heater 35 is optionally wound around at least a portion, or all of the material lines 34 to keep the resin 26 and activator 28 in the lines in a flowable condition. The heater on the material lines 34 is optional.

The pressure feed roller 36 comprises any of numerous existing roller designs for continually applying a pressurized fluid to the roller. These pressure feed rollers 36 include those found in U.S. Pat. Nos. 4,692,048, 6,331,327 and 4,217,062, with the complete contents of each of those patents being incorporated herein by reference. The pressure feed roller 36 includes a perforated rolling element 40 and a bent fluid tube 41. A handle 42 is optionally included in the pressure feed roller 36. The handle 42 is typically connected to the bent fluid tube 41 in various ways, typically by a threaded connection or a bracket. The bent fluid tube 41 can have various configurations, and may fasten to the handle 42 various ways. The support tube 41 can have handle 42 formed around an inlet end of the support tube 41. The perforated rolling element 40 is thus connected to or fastened to the handle 42 in various ways using the bent fluid tube 41.

A static mixing tube 38 is used to mix the plural materials 26, 28 and provides them to the rolling element 40 of the pressure feed roller 36. The static mixing tube 38 is in fluid communication with the material lines 34 through which the separate coating materials 26, 28 are forced at a controlled rate. Preferably, but optionally, the outlet end of the static mixing tube 38 is close to the rolling element 40 so there is little distance and little time delay between the material exiting the outlet of the static mixing tube and reaching the rolling element 40. The static mixing tube 38 is preferably removably connected to the pressure feed roller 36, using any removable connection, with rotatable connections such as threads, bayonet locks being preferred. The static mixing tube 38 is preferably located between handle 42 of the pressure feed roller 36 and the rolling element 40. The motor(s) 30 are controlled by an on-off switch 39, or other appropriate speed control switch, which switch is preferably affixed to the handle 42 or adjacent thereto. "Adjacent" includes a switch connected to the handle 42, bent tube or roller or material transfer lines so as to be within an arms-reach of the handle 42 while the operator stands still and merely reaches for the switch.

Once mixed, the materials 26, 28 begin to harden and the viscosity increases greatly with time. The mixed materials 26, 28 are pressure fed through openings in the rolling element 40 which rolls the mixed materials onto a desired surface where the mixed materials 26, 28 harden to form a protective layer 52 on an object 54.

Figure 6:
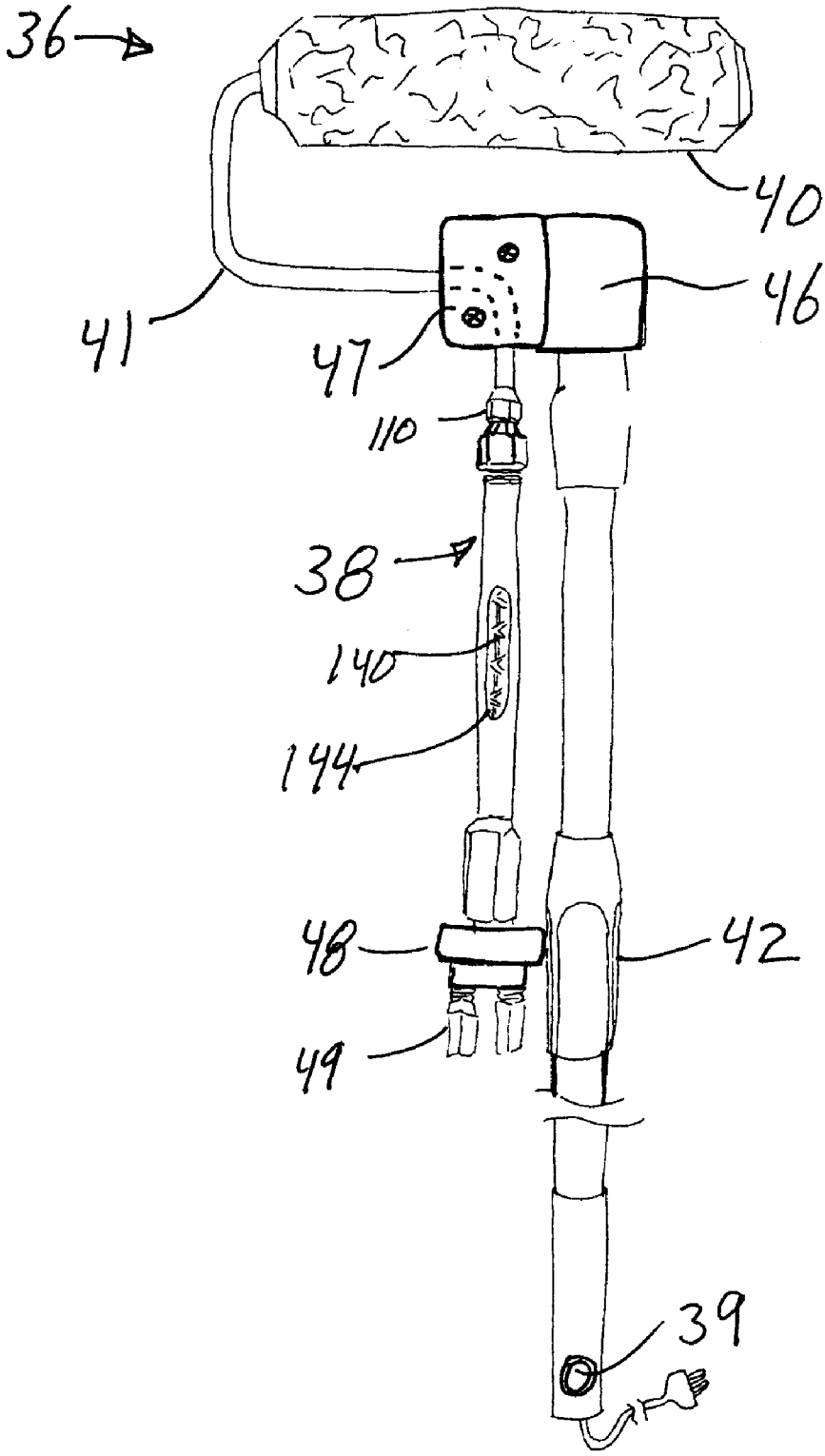
FIG. 6 is a side plan view of a pressure feed roller, static mixing tube and handle.
Figure 7:
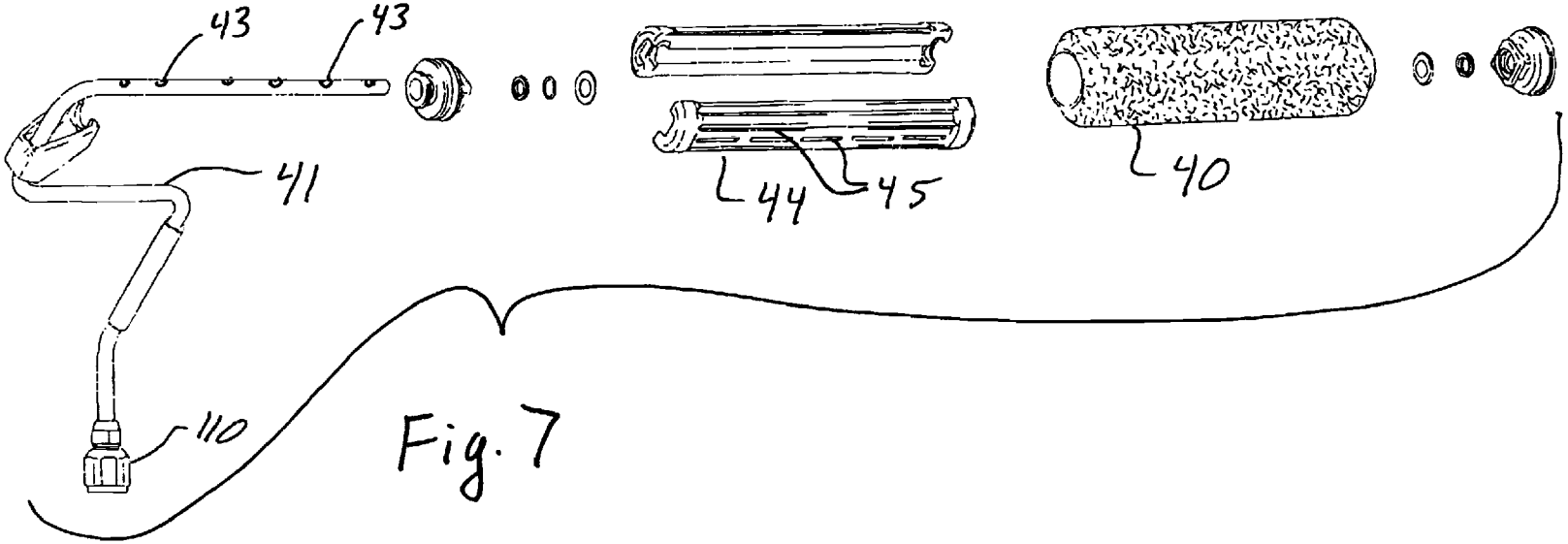
FIG. 7 is an exploded view of one exemplary pressure feed roller for use with the roller system of FIG. 1.

Referring to FIGS. 6-7, the pressure feed roller 36 is described in greater detail as having a tubular support frame 41 through which the material 26, 28 passes to feed the rolling element 40. The frame 41 is generally referred to herein as a fluid support frame. The fluid support frame 41 preferably has a single inlet that is removably fastened to an outlet end of the static mixing tube 38, and has a distal end with number of outlets 43 (FIG. 7). The distal end is typically straight and located inside the rolling element 40 and rollably supports rolling element 40. A roller support 44 is usually concentric with the distal end of the frame 41 and rotates about that distal end of the frame 41, usually concentric with the longitudinal axis of the distal end of frame 41. The rolling element 40 fits over the support 44 and also rotates about the distal end of the frame 41. Typically the rolling element 40 and support 44 comprise cylinders with rolling element 40 sliding over support 44. The support 44 has a plurality of openings 45 which can be of various sizes, shapes and locations and which are located to support the rolling element 40 while allowing the mixed materials 26, 28 to pass from the outlet openings 43, through the support 44 and its openings 45, and then through the rolling element 40. The frame 41, support 44 and rolling element 40 are disposable.

The frame 41 is optionally fastened to a removable handle 42 in various ways. FIG. 6 shows a clamp comprising a groove or recess formed in clamping block 46 fastened to the handle 42. A clamping plate 47 fits over the groove. The frame 41 fits into the groove and screws or other releasable fasteners removably clamp the frame into the groove in the clamping block 46. The frame 41 typically has a 90° bend in it and the groove is preferably L-shaped in order to accept this bent portion of the frame 41. The clamping block is preferably of metal and heavy in order to provide some weight which so that the operator can position the rolling element 40 so gravity causes the weight to push the rolling element 40 against the object being painted or coated. Alternatively, the clamp can be light weight. The clamp can take various forms to releasably fasten the frame to the handle, including releasable snap clamps, ties, brackets, and threaded connections.

In the illustrated embodiment of FIG. 6, the static mixing tube 38 is parallel to the elongated handle 42. The inlet end of the static mixing tube is fastened to a manifold 48 which has inlets 49 configured to fasten to the ends of the material lines 34*a*, 34*b*. Rotatable connections on the inlets are preferred, such as threaded connections or twist-lock connections. The manifold can optionally be fastened to the handle 42 in various ways, including releasable fasteners (e.g., screws), snaps, interlocking fittings, etc. The handle 42 can be a longer handle that is fixed in length or telescoping and extendable.

The cart 20 is advantageously a metal framed cart, preferably of steel. But other materials can be used, including polymers. The cart 20 could be open, but is preferably at least partially enclosed, with access doors 60 provided where and as needed to allow access to the interior space and the components mounted in that enclosed space. The location of the components will vary, as will the number, size and location of the access doors 60. The enclosed space in the cart 20 is also preferably insulated in order to help maintain the resin or urethane 26 and activator or catalyst 28 at desired temperatures and to maintain an even temperature within the interior of the cart. All surfaces of the cart 20 are preferably insulated, but it is believed suitable to insulate only the four, vertical sides 62 of the cart. A ½ inch thick, expanded polystyrene foam is believed suitable for the preferred embodiment. To increase portability, the cart 20 preferably has wheels 64 and a handle to push and position the cart. A rectangular cart with four wheels is believed suitable. A cart about three feet high, three fee long, and three feet wide is believed suitable, not counting the height of wheels 64

The top 68 of the cart 20 preferably has openings into which the tanks 24 are placed. The openings are sized and shaped to conform to the cross-section of the tanks 24. The tanks 24 optionally have one or more projections or rims 70 extending therefrom which are larger than the openings in the cart and which prevent the tanks from sliding entirely into the tank. If desired, one or more or all of the tanks 24 could be entirely enclosed within cart 20. But the two tanks 24 are preferably accessible from the exterior of the cart for refilling and for checking the level of material within the tanks.

Figure 21:
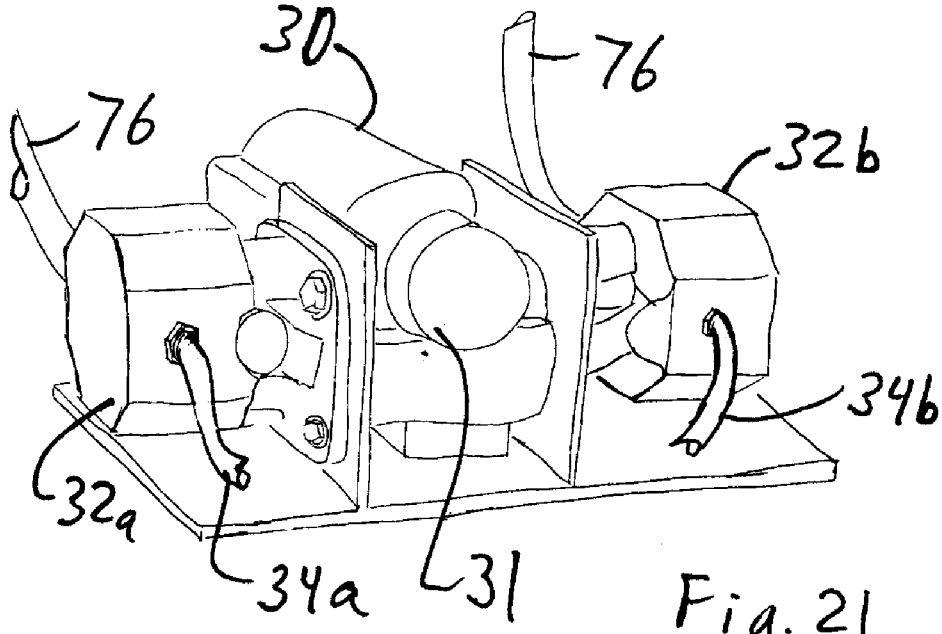
FIG. 21 is a perspective view of a single motor driving two pumps for use with the cart of FIG. 20.

Preferably a major portion of the tanks 24 is internal to the cart in order to maintain the temperature of the tanks and materials in the tanks. By major portion is meant a sufficient portion to allow the temperature to be maintained, and that typically requires over half of that portion of the tank that contains coating materials 26, 28 to be inside the cart 20. Two, 10 gallon tanks with locking, screw on lids that are sealed with a ½' rubber gasket are believed suitable for the enclosed and heated cart. The tanks 24 are preferably sealed from atmospheric air in order to avoid deleterious effects on the materials 26, 28 that can be caused by the moisture in the atmospheric air. If the tanks 24 are separately heated by static coil heaters or heating pads (with or without built in thermostatic temperature controls), the tanks 24, can be smaller. Tanks of 2-3 gallon size are shown in FIG. 21.

The tanks 24 are preferably of polyethylene or stainless steel, with the projections 70 integrally molded with the tanks when the tanks are formed. The tanks 24 can be refilled through the removable lid, or one or more of the tanks 24 can be physically removed from the cart 20 when empty and replaced with a full tank.

The tanks 24 contain the materials to be rollered or otherwise spread onto the surface to form the protective layer 52. For roller application, these materials are usually at least at room temperature, and as desired can be heated and maintained at an elevated operating temperature range between about 70° F. and 125° F., and more preferably between 70° F. and 100° F. In order to help maintain this operating temperature, the heater 22 is provided. A 110V radiant space heater could be used. But preferably each tank 24*a*, 24*b* has a separate heater, such as a resistance heater 22*a*, wrapped around a portion or the entire tank 24, or a static coil heater, or heating pads with or without built in thermostats. A separate heater 22*a*, 22*b* allows rapid heating, and lower power consumption. The resistance heaters are operable on a 110V or 220V line.

If a radiant space heater is used for the auxiliary heater 22, the heating capacity will vary with the size of the components and the environment in which the system is used. The heaters 22, 22*a*, 22*b* advantageously each have an adjustable thermostat that can be set to maintain the temperature, with only thermostat 23 for the auxiliary heater 22 being shown. The auxiliary heater 22 is preferably operated during the night mode, when the roller system is not being used. Advantageously, but optionally, the auxiliary heater 22 runs off a separate 110 volt line than does the remainder of the devices in the cart 20. During operation, the tank heaters 22*a*, 22*b* run off power from the power source (not shown), and as desired the power source (not shown) can also optionally provide power to the auxiliary heater 22. During prolonged non-operating periods, like overnight or over the weekends, the auxiliary heater 22 can be used to maintain the minimum temperature of the tanks 24 inside the cart, and the material lines 34 stored inside the cart. Because the roller system is not in operation during these prolonged periods, it is advantageous, but optional, to have the auxiliary heater run off the 110 volt line and provide no power to the drive inverter 50.

Advantageously, the temperature is controlled to maintain the temperature of the resin 26 and activator 28 at a minimum temperature of 72° F. or 5° above ambient, whichever is greater. The resin or urethane 26 is typically a blend of polyurethane and polyurea, and is usually colored. Activator or catalyst 28 is typically isocyanate. Both the resin and activator are moisture sensitive, and are preferably used when they are above about 72° F. Depending on the use of the system, other compounds can be used, and more than two tanks 24 and various coating material components can be used. The combination of auxiliary heater 22, and/or individual heaters 22*a*, 22*b* are selected to maintain the desired temperatures of the material lines 34*a*, 34*b* during storage, and to maintain the temperature of the tanks 24*a*, 24*b* during operation, but selected to maintain that desired temperature at sufficiently low power requirements that the system can operate on 110 V.

Figure 3:
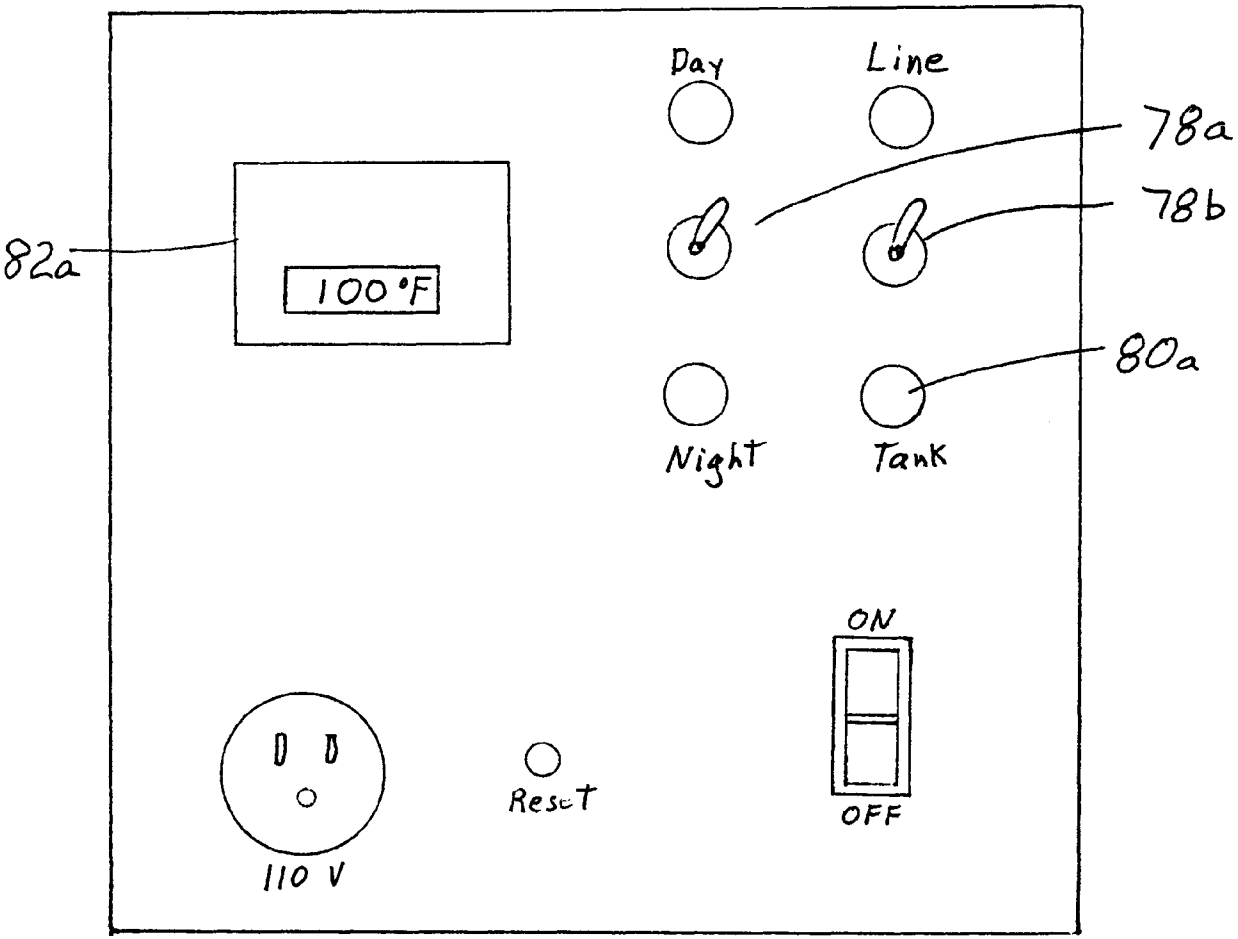
FIG. 3 is a plan view of an electrical control panel used in the roller system of FIG. 1.
Figure 4:
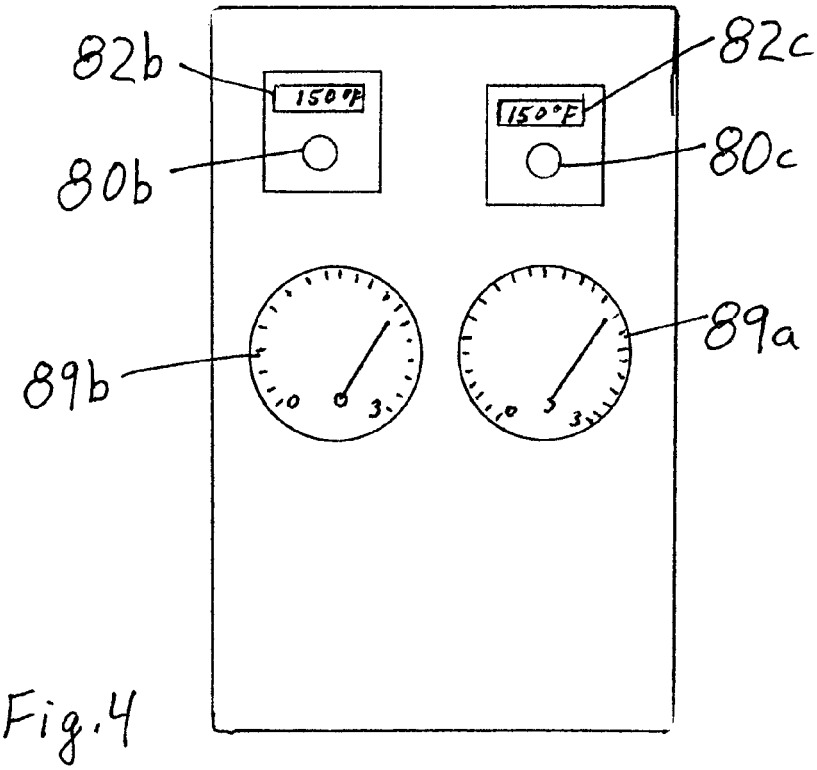
FIG. 4 is a plan view of a pressure control panel used in the roller system of FIG. 1.

Referring to FIGS. 2-4, a variable temperature heater 22, 22*a* controlled by a thermostat can optionally be used to control the temperature of the tanks 24, and/or the material lines 34. A typical operating temperature for the materials 26, 28 is about 110° F. for use in the illustrated embodiment for roller application of pool coating materials. The material lines 34 are preferably maintained at room temperature, but could be maintained a higher temperature than the tanks 24 if desired for use with very viscous materials. But the temperature of the tanks 24 and material lines 34 can vary.

Advantageously the heater and temperature controls are on a separate panel or sub-panel so they can be grouped together. Preferably, but optionally, an on-off switch 78*a* can activate the heater(s) 22, 22*a* for the resin 26 and activator 28 in tanks 24*a*, 24*b* and switch them between a day, operational roller application mode and a night, non-operational-temporary-storage mode in which maintains a preset temperature on the tanks 24 and inside the cart 20 so the material in the lines 34 maintains a desired temperature above ambient for non-use periods. A separate switch 78*b* is preferably, but optionally provided to activate and deactivate the line heater 35. Preferably, but optionally, a separate temperature control 80*a*, 80*b*, 80*c* is provided for the tanks 24, and material lines 34*a*, 34*b*, respectively. Indicator lights can be provided to visually indicate the heaters are activated. An optional master on/off switch can be provided as desired, as can a timer reset button. The electrical connection of these controls is believed known or discernable within the skill in the art, and is not described in detail herein.

Preferably, but optionally, a temperature gauge 82*a*, 82*b* and 82*c* are provided for the tanks 24, and material line 34*a*, 34*b*, respectively. While a single temperature control 80*a* and temperature gauge 82*a* are shown for both tanks 24*a*, 24*b*, a separate temperature gauge and temperature control could be provided for each tank 24. Likewise, while separate controls and gauges 80*b*, 80*c*, 82*b*, 82*c* are shown for the material lines 34*a*, 34*b*, a single temperature control and temperature gauge could be used. Preferably, separate controls are provided because each roller component is likely to have a different preferred viscosity for roller application, and maintaining the preferred viscosity lowers the pumping power and pumping duty cycle. Preferably, the temperature controls and gauges are digital, but analog controls and gauges can be used, as could other controls and gauges.

The viscosity of the coating material will vary with the object being coated and the material used. The resin 26 and activator 28 used to form a pool coating are usually slightly viscous materials, having a viscosity of about 400 centipoises. But the specific component materials 26, 28 that are used, as well as the temperature of the component materials 26, 28 will affect the viscosity, and those materials can vary. The pumps 32 and motor or motors 30 must be sized appropriately for the viscosity of the coating materials to be used with pressure feed rollers 36 and the object to be coated or painted. Further, depending no only on the thickness of the materials being pumped through the lines 34 and the ease with which the material passes through the perforated rolling element 40, various sized motors and pumps will be needed.

Pumps 32 with a rating of a few gallons per minute are believed suitable for use in roller or squeegee application of the above material to surfaces, primarily floors and walls. These pumps 32 are used to pump the resin 26 and activator 28 from tanks 24*a*, 24*b*, to the pressure feed roller 36. By placing both pumps 32 on a common shaft driven by a single motor 30, the pumps 32 can pump the plural component materials at the same rate. But during use of the roller system the pumping requirements will vary, depending in part on the object roller coated and the material used with the roller. Other types of pumps can be used, including peristaltic pumps. A peristaltic type of line pump is shown in U.S. Pat. No. 4,217,062, the complete contents of which are incorporated herein by reference.

The material 26, 28 is usually provided in equal amounts or a 1:1 ratio to the static mixing tube 38. But the gearing 56 could be changed to provide the material 26, 28 in other ratios. Ratios of 1:2 or multiples thereof are most common, but appropriate gearing could provide other ratios. Alternatively, each pump 32 could be driven by a separate motor, and each motor could be driven at a fixed speed or multiples of a fixed speed in order to provide fixed pump speeds at specified ratios. Thus, for example, a first motor could rotate twice as fast as the second motor, causing the pumps to pump material 26, 28 in a ratio of 1:2 or 2:1, depending on which motor drove which pump. Moreover, each of the separate motors 30 could be a variable speed motor to provide an adjustable ratio of materials 26, 28 to the static mixing tube 38. The motor(s) 30 are controlled by an on-off switch 39, or other appropriate speed control switch, which switch is preferably affixed to the pressure feed roller 38, and more preferably fastened to or near the handle 42.

Referring to FIGS. 2 and 4, a fluid line 76 places each tank 24 in fluid communication with one of the pumps 32. Preferably, one end of fluid line 76 removably connects to a fitting on the bottom of a tank 24 so the tank can be removed and replaced if desired. The other end of each fluid line 76 is connected to one of the pumps 32. A ½ inch port on the tank, and the same sized tubing are believed suitable for the preferred embodiment. The pumps 32 and motor 30 are preferably enclosed within the cart 20 to maintain the temperature of the plural component materials, resin 26 and activator 28. But enclosing the pump 32 and motor 30 also allows the heat from the pump to be used to maintain the operating temperature of the cart 20 and coating materials enclosed within the enclosed cart. Obviously, if the cart is not enclosed the heat from the pump will not warm things very much.

The plural component materials, the resin 26 and the activator 28, are sensitive to moisture as well as being sensitive to temperature. As the level of material within each tank 24 lowers, air enters the tank and the air can contain sufficient moisture to affect the performance of the roller application and hardening of the materials. An airline is attached to each sealed tank and also connected to a desiccant filter that removes moisture from the air as the air passes through it to the tank. Alternatively, the desiccant filter can be removed, and the air line can have a distal end opening into the interior of the cart 20, because the heat inside the cart can drive out sufficient moisture to provide a source of air that is sufficiently moisture-free to avoid undesirable affects on the materials in the tanks 24.

Referring still to FIGS. 1-2, a pressure regulator 86 is preferably, but optionally used to regulate the pressure in the material line 34 so that the pressure in each material line 34 can be independently adjusted using pressure regulator 86. A pressure sensor, illustrated as a pressure gauge 88, monitors the pressure to make use of regulator 86 easier.

In the illustrated embodiment, each pump 32*a*, 32*b* pumps at a constant rate in order to use a low power for the pumps. The amount of material 26, 28 provided to pressure feed roller 36 is regulated or varied by returning a portion of the pump output to the tanks 24. Each pump 32*a*, 32*b* has a return line 90*a*, 90*b* running from the downstream side of the pump 32 back to the respective tank 24*a*, 24*b*. The pressure regulator 86*a*, 86*b* is adjusted to vary the amount of material 26, 28 returned to the respective tank 24*a*, 24*b*, and that regulates the amount of material in the respective material lines 34*a*, 34*b*. The pressure gauge 88*a*, 88*b* indicates the pressure in the return line and also indicates the pressure in the associated material line 34*a*, 34*b*. The pressure gauges 88*a*, 88*b* could thus also be placed on the respective material lines 34*a*, 34*b*. By monitoring the pressure in the lines downstream of the pumps 32*a*, 32*b* using gauges 88*a*, 88*b*, and by adjusting the pressure regulators 86*a*, 86*b*, the pressure in the material lines 34*a*, 34*b* can be adjusted to a desired pressure for each line. Each line 34*a*, 34*b* is of a fixed cross-sectional area so by varying the pressure, the flow rate of material to the pressure feed roller 36 can also be varied or adjusted. The pressure regulators 86 and gauges 88 are optional, and may be omitted, especially if the material being applied is fairly thin and not very viscous.

Referring to FIGS. 1-2 and 4, if pressure regulators are used, then the output of the pressure sensors are preferably visually displayed, as through pressure gauges 88*a*, 88*b* on an externally accessible control panel. Controls 89*a*, 89*b* allow adjustment of the regulators 86*a*, 86*b*. Running the controls 89*a*, 89*b* to an externally accessible control panel avoids having to open doors 60 in the cart to access the gauges 88 and regulators 86 to adjust the pressure in the material lines 34. If pressure regulators 86 are not used, then the controls 89 are not needed.

Gauges 88 and regulators 86 with an upper pressure range of a few hundred psi are believed suitable for the illustrated embodiment suitable for roller application of pool liner material. For thinner coating materials with a viscosity of about 400 centipoise, a pressure range of about 20-110 psi is believed suitable. The pressure regulators 86 are preferably, but optionally constructed with seals made of polytetrafluoroethylene (PFTE). The PFTE seals resist seal swelling which can require more power to operate the regulators 86. The PFTE seals are also more resistant to degradation from the materials likely to be used in the roller system, and thus maintain the operating pressures better and in turn require lower power to drive the pumps 32 as the regulators wear with use.

The motor 30 is placed inside the cart 20 to allow the heat from the motor to be used to maintain the temperature inside the cart. If the motor 30 generates too much heat, it can complicate the operational control of heater 22. Thus, it may be advantageous to place the motor 30 in a sub-compartment within the cart 20, and to insulate that sub-compartment. Moreover, it is believed possible, but not desirable, to have the motor 30 located outside of the heated portion of the cart 20. Preferably though, the motor 30 is placed inside the cart 20, and heat from the motor is used to help maintain the temperature of coating or painting materials 26, 28.

The preferred pressure feed roller 36 preferably, but optionally, does not use gas or air to force the materials 26, 28 through the mixing tube 38 and through the pressure feed roller and out the rolling element 40. Rather, the pressure feed roller 36 preferably uses the pressure from pumps 32 to force the materials 26, 28 through the static mixing tube 38 and through the rolling element 40. A suitable pressure feed roller is provided by Graco.

Material lines 34*a*, 34*b* carry the resin 26 and activator 28 from the hydraulic pumps 32 to the special pressure feed roller 36. Even though the pressure carried by these lines is low, the lines 34 are preferably a high strength line that reduces the radial expansion of the line under operating pressures. The lines 34 are preferably a made of a stiff material that does not expand radially under pressure. A line 34 having a Teflon tube with a flexible, stainless steel braid surrounding the Teflon for burst resistance is believed suitable for highly viscous materials. A burst pressure on these Teflon-steel braided material lines 34 of about 5,000 psi is desirable. The general operating pressure from the material pumps 32 is usually less than a few hundred psi with 20-110 psi being common for thinner, two-part urethane paints, so the pressure in the line 34 is less than 100 times the burst strength of the line. If more vicious coating materials are used, then the pressures can increase to several thousand psi, and the higher strength lines are desirable. In a less preferred embodiment, lower strength lines 34 can be used, having a burst pressure of about 2,500 psi. Even lower pressure lines are believed suitable for use with lower pressure applications of the type used with the squeegee applicator.

When the roller system is not being used, the material lines 34 are disconnected from the pressure feed roller 36 and connected to the tanks 24 by connectors on the tanks so that the materials 26, 28 can cycle through the lines periodically to eliminate material build up in the lines and to keep the material in suspension. A circulation of 10 minutes every 4 hours via an automatic timer that is tied to the pump motor 30 is believed suitable for the preferred embodiment. The appropriate time intervals will depend on the materials used, the insulation of the cart 20, the size of the heater and the environmental temperature.

If the connector is placed on the tank 24 external to the cart 20, then the tank can be readily disconnected and removed from the cart. The connection with the activator tank 24*a* is preferably, but optionally, provided internal to the cart 20 when large tanks are used and when the interior of the cart is heated. The activator 28 is more temperature sensitive so the internal location of the connector helps maintain the temperature. Advantageously, the cart 20 has a shelf or sufficient space to allow the entire material line 34 to be placed inside the cart 20 when the roller application system is not in use. This allows the temperature of the entire line 34 to be maintained by the cart 20 and its temperature controlled interior via heater 22. The shelf or space to store the material lines 34 is advantageously accessible through a door 60.

Figure 20:
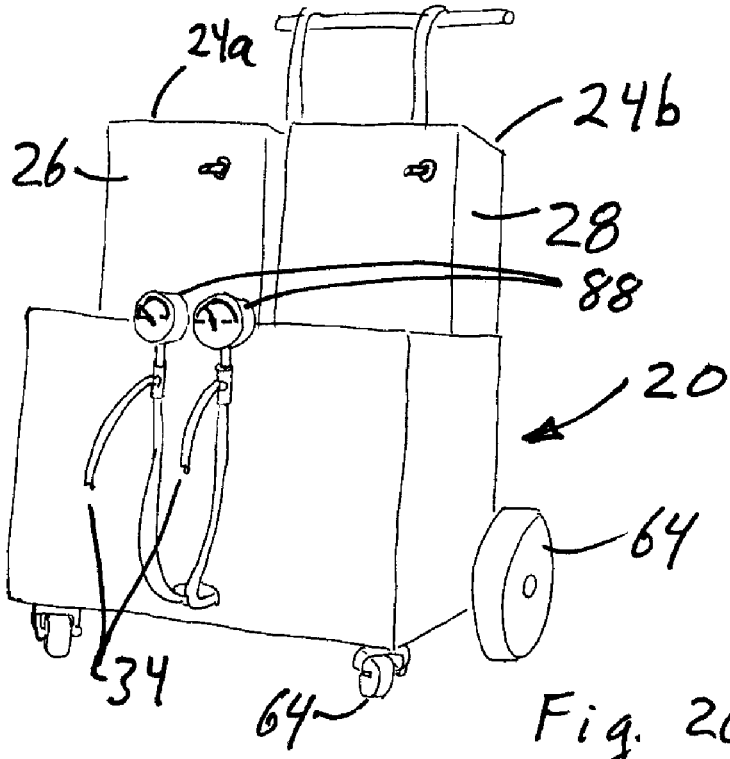
FIG. 20 is a perspective view of a cart for the squeegee and roller.

In lighter weight, more portable embodiments where the tanks 24 are not enclosed within a heated cart, the tanks are individually heated by separate heaters 22. In such cases the motor(s) 30 and pump(s) 32 are placed in a small compartment that can be located below the tanks as shown in FIGS. 20-21.

The motor 30 can take the form of any motor that is commercially available now, or in the future. Ideally, the motor is a 110 volt, double stack, low-ramp DC motor (DSLR). The motor is preferably a 90V motor, about 1.7 hp, operating at about 2500 rpm. The output of motor 30 is through a rotating drive shaft which drives gearbox 31. A modular designed gear box is preferred, with a gear reduction of about 5:1 believed suitable, with an output speed of about 2500 rpm. Advantageously, but optionally, helicoid gears are used with fiberglass bushings on the gears and/or input and output shafts, to provide high capacity and high efficiency. Further, the gear shafts are optionally hollow, and larger than would be normal for a solid shaft gear system. The gear reduction 31 preferably uses synthetic lubricants to reduce temperature and to increase operating and service life. The output from gear reduction 31 is preferably through a large diameter shaft allowing a larger diameter bearing to accommodate increased torque from the motor 30 and gear reduction 31. To simplify the system when the materials 26, 28 are not very viscous, the gear reduction 31 can be omitted and the motor 30 can directly drive the pumps.

If thick and very viscous materials are used, then the 110 line input voltage preferably passes through a drive inverter 50 and preferably that also uses a pulse width modulated (PWM) signal to reduce the operating current to the motor 30. The drive inverter 50 converts the 110 volt AC current into a DC current, and preferably, but optionally, into a square wave DC current. This is believed to improve efficiency and life of the motor 30. The DC current is applied to the motor 30 and to the heaters 35 on the material lines 34, and to any heaters on the tanks 24. Preferably, but optionally, a variable speed control 51 is provided to vary the speed of the motor 30 by varying the voltage from the drive inverter 50 to the motor.

Preferably, the motor 30 is of modular construction and is coupled to the pumps 32 through couplers 56. The couplers 56 allow the motor 30, or either of the pumps 32, to be more easily removed. The pumps 32 are high efficiency, positive displacement pumps which do not loose pressure under extreme operating conditions. The viscosity of the resin 26 and activator 28 will vary, and the pumps have to work efficiently, with low power requirements.

To use the system, the cart 20 is connected to a standard 110V power outlet. Materials 26, 28 are placed in the tanks 24, and the power is turned on using a master power switch (FIG. 3). The heaters 22*a*, 22*b* around the tanks 24 and any auxiliary heater 22 inside the cart 20 are activated and the desired temperatures set using the controls 80. If the materials 26, 28 do not require heating, then the heaters 22 and associated temperature control equipment and instruments are either omitted from the system or turned off. When the temperature of materials 26, 28 reach a desired temperature (e.g., about 110° F.) as indicated by the sensors or by the displays 82, the heaters 35 on the material supply lines 34 are activated if such heaters are present. The line heaters 35 can be omitted for materials 26, 28 that are thin and flowable at room temperature. Shortly before, or after activation of the line heaters 35, the material lines 34 are connected to the tanks 24 and the pressure feed roller 36 is connected to the material lines. When the material 26, 28 is at a suitable temperature and suitably flowable, the pumps 32 are activated and adjusted as desired. A pressure of about 300 psi or less, and preferably about 20-110 psi is believed suitable for the illustrated embodiment of roller application of pool coating material or two-part urethane paints. But again, the pressure will vary with the materials used so while pressures of less than a couple hundred psi are usable with thinner coating material, the thicker material can require much higher pressures. The desired object 54 is then rollered to form coating 52.

After roller application is finished, the power to the heaters 22 is turned off. The material lines 34 are disconnected from the pressure feed roller 36, and the pressure feed roller is discarded, or at least the static mixing tube 38 and rolling element 40 are discarded while the remaining portions may be cleaned with suitable solvent such as paint thinner, acetone or other solvents appropriate for the material being applied by the roller. The coating materials harden, sometimes within a few minutes, and the mixed materials 26, 28 on the rolling elements 40 and static mixing tube 38 become hardened, rendering the mixing tube 38 and rolling element 40 unusable. The ends of the material lines 34 that were connected to the pressure feed roller 36 are connected to the tanks 24 so material can recirculate through the lines 34 and tanks 24. The system is switched to the night mode using switch 78*b*, which optionally lowers the temperature in the tanks 24 to a standby or overnight temperature that is optionally lower than the operating roller application temperature, and that periodically activates pumps 32 to recirculate material 26, 28 through the lines 34.

The roller system disclosed herein can operate on a standard 110V power outlet. The current drawn by the pump 32 and line heaters 35 varies with the materials 26, 28. As the viscosity of the materials varies, different motors can be used. If more viscous materials are used, a double stack, DC motor becomes more desirable as it provides high torque at low amperage, and is a small (e.g., 1.75 HP) motor. The cart 20 of the present invention is sufficiently portable that it can fit into an elevator and be moved into position by a single person.

Referring to FIG. 8, a further embodiment of the pressure feed roller 36 is in which the two material lines 34*a*, 34*b* fasten to the end of a handle 42 and extend internal to the handle to the mixing manifold 48 located at a distal end of the handle. The mixing manifold has fittings in fluid communication with the material lines 34 and combines those plural inputs into a single outlet in fluid communication with the inlet end of mixing tube 38. In the depicted embodiment the mixing tube is made part of the tubular frame 41 by inserting a static mixing tube into the portion of the tubular frame that fastens to the handle 42. Thus, the mixing tube 38 need not be a separate piece from the frame 41, but could be a part of the frame and pressure feed roller 36. The frame 41 fastens to a mating fitting on the manifold 48 which in this embodiment is located at the distal end of the handle, adjacent the pressure feed roller 36. Switch 39 is in electrical communication with the motor 30 to control the feed of materials 26, 28 to the pressure feed roller 36.

Referring to FIGS. 8-9, a further embodiment of a pump 32 is shown, comprising a peristaltic pump having a motor (not shown) rotating a bar 100 having a roller 102 on each opposing ends of the bar. The bar 100 and pinch rollers 102 are located in a housing 104 having walls 106 defining a cylindrical cavity with the material lines 34 placed between the rollers 102 and walls 106. Three material lines 34*a*, 34*b*, 34*c* are shown. As the bar 100 rotates, the pinch rollers 102 pinch or compress the material lines 34 and force material 26, 28, etc. through the lines. The shape of the cavity formed by the wall 106 can vary as indicated in the dashed lines in order to vary the amount that one or more lines 34 are compressed, as reflected by FIG. 9. The shape of wall 106 relative to the location of one or more lines 34*a*, 34*b*, 34*c* can be used to vary the relative amount of material pumped through each line 34. Recesses or grooves 108 can thus be placed in the wall 106 about a portion of the generally cylindrical cavity to vary the amount of material pumped through the material lines 34.

There is also provided a mixing assembly for use with a preexisting pressure feed roller assembly having a handle 42, a bent fluid tube 41, and a pressure rolling element 40. The bent fluid tube 41 has a connector 110 for connecting to a source of fluid material to be applied by the rolling element rollably supported on a distal end of the bent fluid tube. The connector 110 is typically a threaded connector, but other connectors could be used. The manifold 48 with its two or more inlet fittings 49 releasably connect to distal ends of material transfer lines 34. The manifold has a single outlet placed in fluid communication with the inlet of the static mixing tube 38. Typically the mating fittings are also threaded connections. The mixing tube outlet is placed in fluid communication with the bent fluid tube, usually via threads mating with the threaded connector 110. Preferably, but optionally, the manifold is fastened to the handle 42, and more preferably releasably fastened to the handle. Likewise, the mixing tube can also be fastened to the handle 42, either directly by being placed inside the handle 42 (FIG. 8) or by being directly fastened to the handle, or by having the bent fluid tube 47 being fastened to the handle Optionally, the static mixing tube comprises a portion of the bent fluid tube (FIG. 8).

The above description is given by way of example, and not limitation. Given the above disclosure, one skilled in the art could devise variations that are within the scope and spirit of the invention, including various ways of using the present method and roller apparatus to coat various surfaces 52 other than swimming pools. For example, concrete surfaces or surfaces on the inside or outside of buildings could be painted or coated with the method and apparatus of this invention. Other surfaces, preferably, but optionally, hard surfaces, can be coated for the purpose of waterproofing and abrasion or impact resistance using the resins involved here. Further, the various features of this invention can be used alone, or in varying combinations with each other and are not intended to be limited to the specific combination described herein. Thus, the invention is not to be limited by the illustrated embodiments.

This invention also further comprises a method of applying a multi-part epoxy by a pressure feed roller by placing a first end of material transfer lines 34 in fluid communication with appropriate 24 containers of activator and resin 26, 28. Multiple part coatings 26, 28 are pumped to a static mixing tube 38 which has an outlet in fluid communication with pressure feed roller 36. Preferably the outlet end of the mixing tube 38 is threadingly engaged with the inlet end of ht bent fluid tube 41. The mixing tube 38 mixes the activator and resin 26, 28 and the bent fluid tube 41 passes the mixed material to the rolling element 40 for coating a surface 52 on object 54 (FIG. 2). Preferably, but optionally, the method in includes fastening the mixing tube to the handle 42, with the bent fluid tube 41 also being fastened to the handle. Switch 39 activates the pump(s) 56 to regulate the material provided to the mixing tube 38 and rolling element 40.

When coating is completed, the mixing tube 38 and manifold 48 can be removed from the handle 42 and discarded. Alternatively, the mixing tube 38 can be removed and discarded while the manifold 48 is reused, preferably after removing any intermixed materials that have hardened in the manifold. Likewise, the pressure feed roller 36 can be removed and replaced. The manifold 42 and mixing tube 38 can be provided as a unit, or provided with pressure feed roller 36 and bent fluid tube 41.

Figure 11:
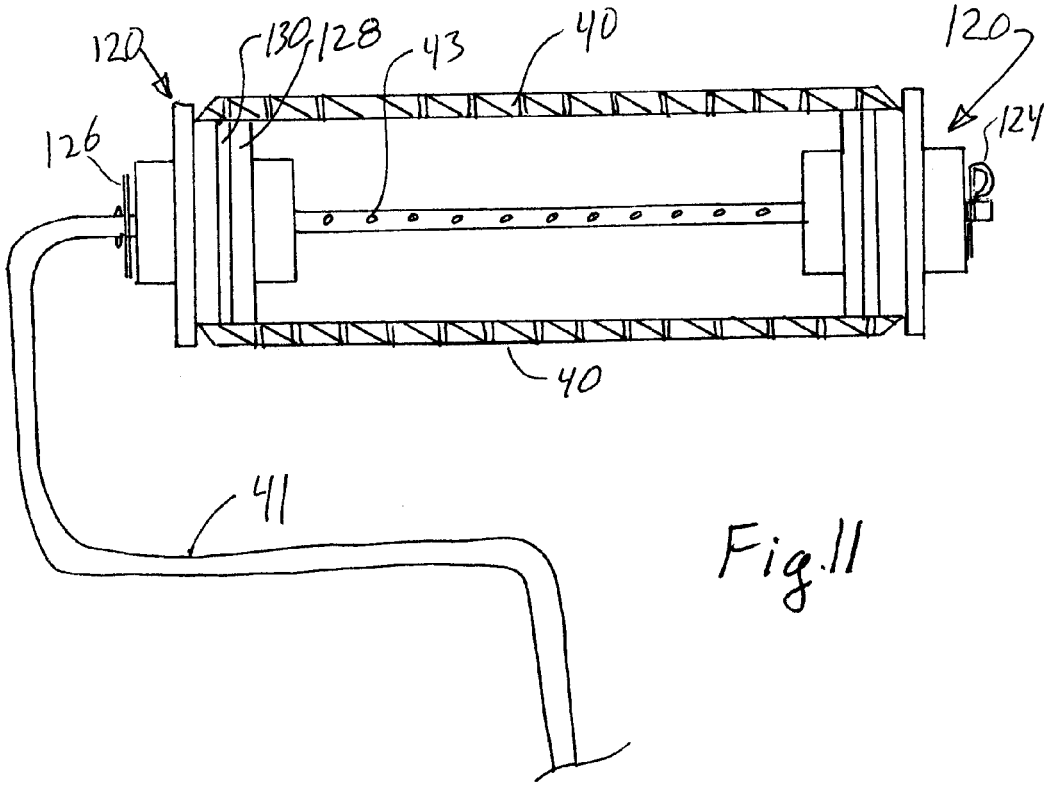
FIG. 11 is a side view of a pressure feed roller with the rolling element cut-away.
Figure 12:
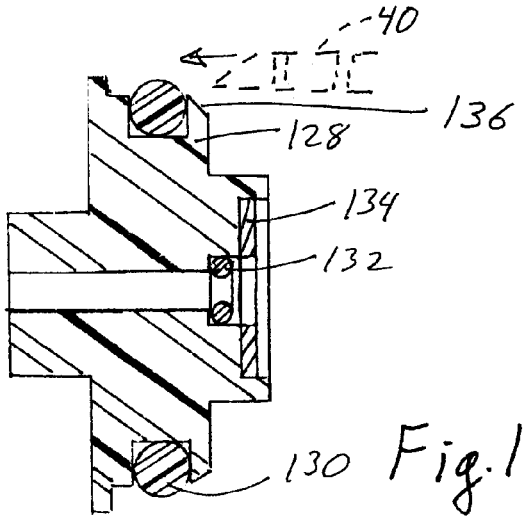
FIG. 12 is a cross-section of an end cap for the pressure feed roller of FIG. 11.

Referring to FIGS. 10-11, a pressure feed roller 36 is shown with the rolling element 40 in cross-section. The bent fluid tube 41 has a distal end that passes through two end caps 120 that rollably support that distal end, with a plurality of outlets 43 in the distal end located between the end caps. The end caps 120 are prevented from moving along the length of the distal end by a cap stop 122 and a cotter key 124 each of which are on opposing sides of the end caps. The cap stop 122 comprises a raised portion on the exterior of the bent fluid tube 41 which abuts a stop washer 126 while a cotter key 124 extends through a hole in the distal end of tube 41 to limit movement of the end cap 120 adjacent the cotter key. In the embodiment of FIG. 7, the lateral movement is prevented by a bracket cooperating with the bent shape of the tube 41. The bent fluid tube 41 has its end plugged so material cannot flow out through the hole that accepts the cotter key 124.

The end caps 120 each have a cylindrical boss 128 sized to mate with the inside diameter of the rolling element 40. A seal, such as an elastomeric O-ring seal 130 encircles the boss and rests in a recess in the boss to form a fluid tight seal between the boss 128 and the inside of the rolling element 40.

Referring further to FIG. 11, the distal end of the bent fluid tube 41 passes through a cylindrical hole in the end caps 120, with another sealing element, such as O-ring seal 132 (FIG. 11) preventing fluid transfer from the inside of the rolling element 40 along the length of the distal end. A disk shaped elastomeric washer can encircle the distal end of the bent fluid tube 41 adjacent seal 132 to further help prevent fluid transfer out of the inside of rolling element 40. be Preferably the inner edge of the boss 128 has a chamfer 136 inclined in a direction that makes it easier to push the rolling element 40 onto the boss 128 and across seal 130.

Figure 13:
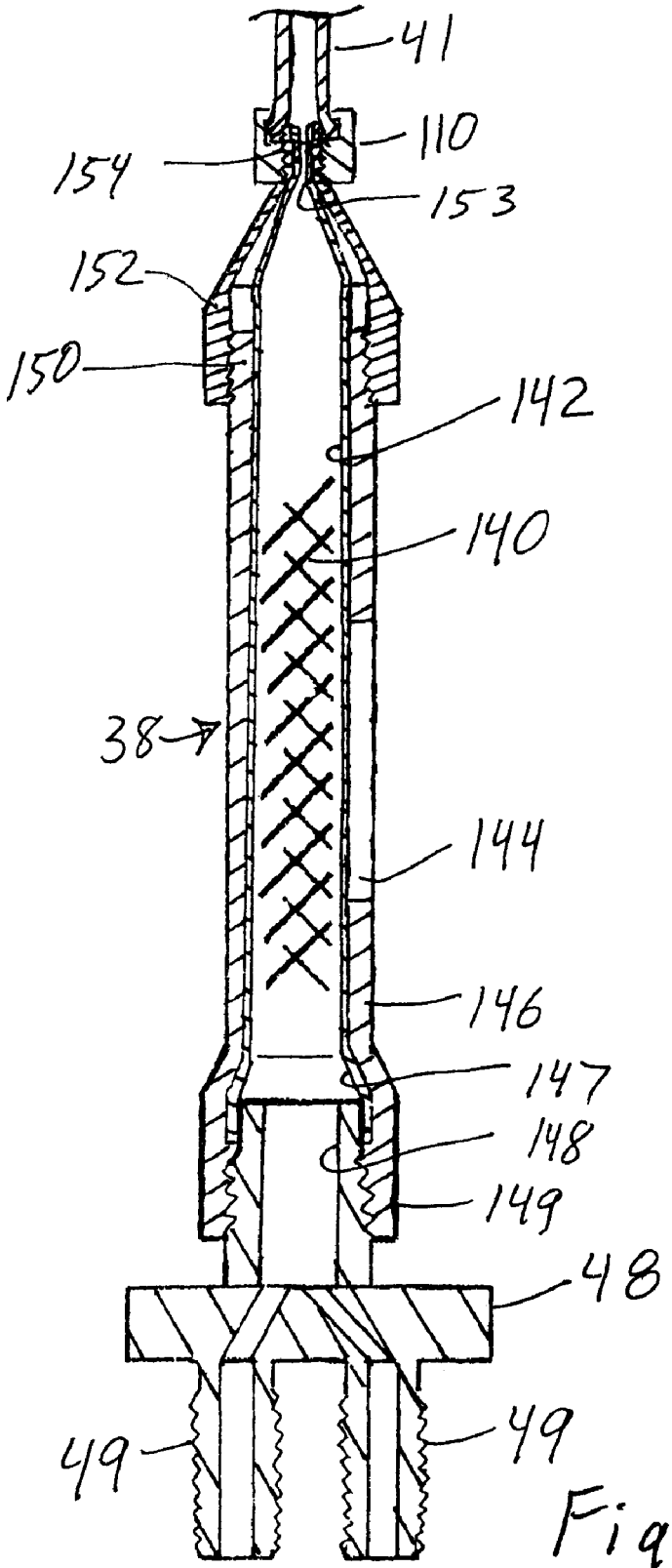
FIG. 13 is a cross sectional view of a mixing tube connected to a manifold and bent fluid tube.

Referring to FIGS. 6 and 13, a further description of the static mixing tube 38 is provided. Preferably, the static mixing tube 38 comprises a static mixing element 140 contained in a thin walled tube 142. A #18 or #24 static mixing element 140 having 18 or 24 elements, respectively. These static mixing elements are about ⅜ inch diameter, and about 8-10 inches long, and contained in a tube 39 having one end connected to the pressure feed roller 36 and the other end connected to the material lines 24. The tube 142 could be of transparent material such as a suitable strength and chemical resistive plastic and that configuration is shown in the drawing.

The tube 142 is enclosed in a housing 146, which preferably, but optionally, has an opening or transparent window 144 allowing 144 (FIG. 6) in a portion of the tube 142. The window 144 is large enough and located such that the operator can visually see materials 26, 28 pass through the mixing tube with the unaided eye. If the tube 142 is made of opaque material, then preferably a suitable transparent window is also formed in the tube 142 to coincide in location with the window 144.

The inlet end 147 of the tube 142 is flared to fit over a tapered outlet 148 of the manifold 48 to help form a fluid seal. The inlet end 149 of the housing 146 is threaded to mate with corresponding threads on the manifold outlet 148. Internal threads are shown, but the parts could be configured so the housing 149 had external threads mating with internal threads on the outlet 148. The outlet end 150 of the housing 146 is threaded to mate with threads on connector 152. External threads are shown, but the location of threads on the connector 152 and outlet end 150 could be reversed. The connector 152 has an outlet end 154 that is threaded to mate with the flared swivel connection 110 on the bent fluid tube 41. An outlet end 153 on the tube 142 is tapered to fit inside the tapered outlet end 154 on the connector 152 and preferably, but optionally, forms a fluid tight seal. The connector 152 can be threaded along the length of housing 146 until it abuts and seals against the outlet end 158 of the tube 142. The connector 152 thus encloses and positions the outlet ends 153, 154 to provide a fluid tight connection to the connector 110 on the bent fluid tube inside 41.

The housing 142 supports the thin walled housing 142, so the housing 142 is preferably, but optionally made of stronger material such as metal, preferably steel. Further, the threaded connections provide a releasable connection that allows the housing 146, tube 142 and mixing element 140 to be removed and discarded. Moreover, the tube 142 and mixing element 140 could be removed from housing 146 and discarded, with the same housing 146 being reused with a new tube 142 and mixing element 140.

It is believed possible to combine the fluid tube 142 and housing 146 into one part. Further, other ways of enclosing and connecting the static mixing tube 140 exist and can be used. The tapered outlet on the tube 142 and housing 146 can be less severe and even omitted if suitable sealing connections are provided.

Referring to FIGS. 14-21, instead of using a roller to apply the materials a squeegee 200 is provided. Briefly described, the mixing tube 38 is in fluid communication with manifold block 202 through a suitable releasable connector 204, preferably a threaded connector. The mixed activator and resin 26, 28 pass through the manifold 202 and out transfer tubes 206 connected to the manifold 202, and also preferably, but optionally, out holes 208 in the manifold block 202. The mixed accelerator and resin 26, 28 fall onto the surface 209 being coated, such as a floor. The squeegee 200 spreads the mixture onto the surface 209. Various chips 211 may be adhered to the surface to act as spacers and provide a coating of predetermined thickness.

In more detail, the manifold block 202 has fitting or connector 204 adapted to connect to the mixing tube 38. Internal passages 210 place the connector 20 in fluid communication with holes 208 that are preferably on the bottom side of the manifold block 202, opening toward the surface to be coated 209. The internal passages are also in fluid communication with transfer tubes 206 that extend sideways or laterally from the manifold block 202. The tubes 206 preferably screw into the manifold block 202 using threaded ends 207 (FIG. 16) that mate with threads in manifold block 202. Bayonet threads and other quick lock connections could also be used to releasably fasten the tubes 206 to the block 202.

Figure 15:
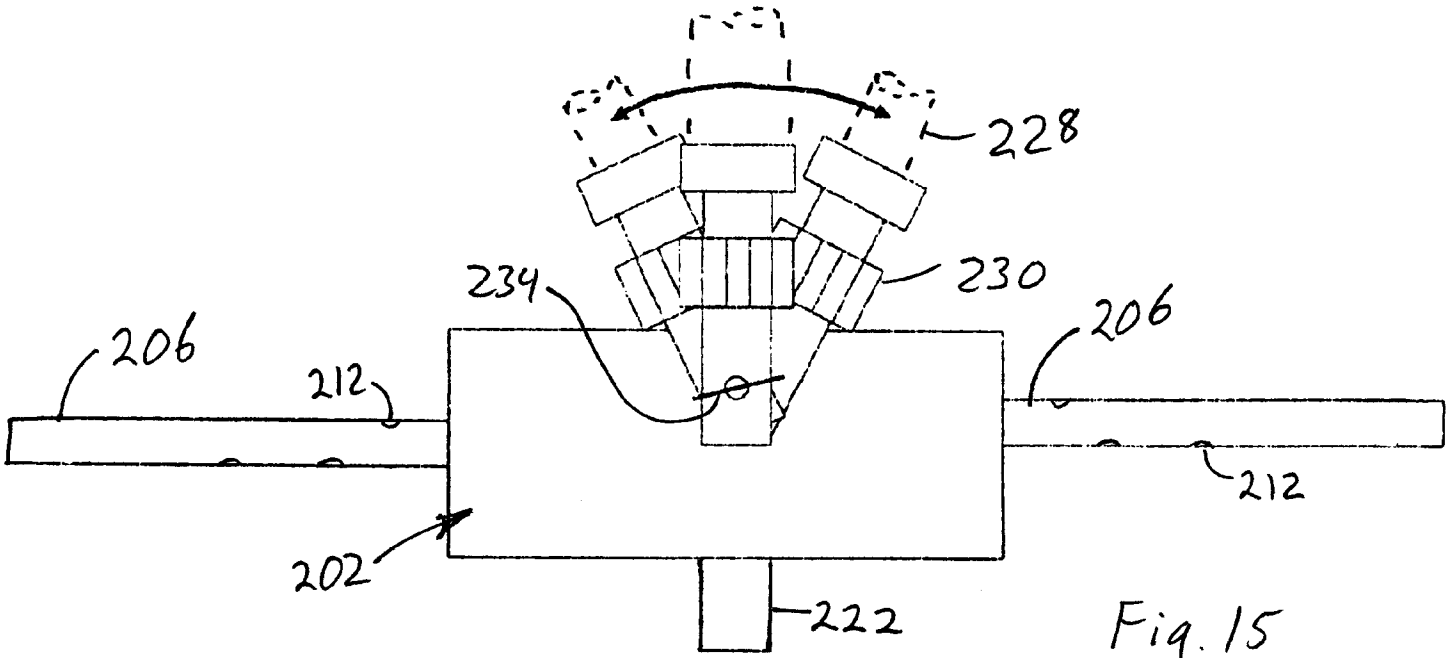
FIG. 15 is a top view of the applicator block of FIG. 14 with the distribution tubes and without a squeegee.
Figure 19:
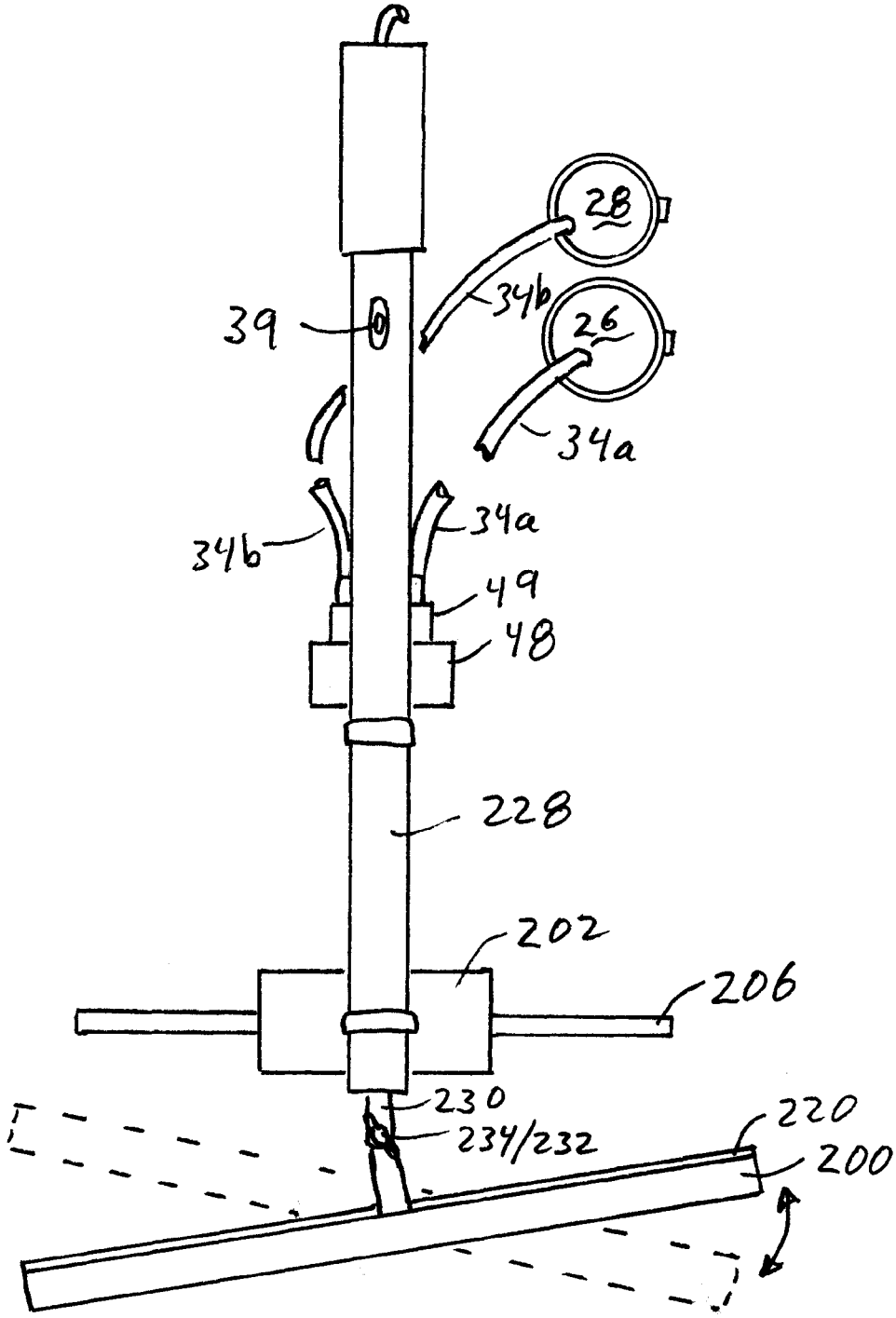
FIG. 19 is a top plan view of the squeegee of FIG. 18.

The longitudinal axis of tubes 206 can be aligned along a common axis and could comprise a continuous tube passing through the manifold 202 and extending out of opposing sides of the manifold as in FIG. 19. Alternatively, as shown in FIG. 15, the tubes 206 can be offset and generally parallel. The tubes 206 preferably extend along the length of the squeegee 200 and are generally parallel to the squeegee. The tubes 206 distribute the mixed activator and resin 26, 28 along the length of the tube, preferably through openings or holes 212 in the tube. In order to allow even distribution of the mixed activator and the holes 212 located toward the distal end of the tube 206 can be larger than the holes nearer the manifold block 202. Alternatively, the holes 212 nearer the distal end can be orientated so the holes face the surface 209 to be coated so the material is directly dispensed onto the surface to be coated. The holes 212 nearer the manifold can be located on the side or upper portion of the tube's cross-section so they still dispense the coating material directly onto the surface to be coated. This configuration can also be described as having a first hole or holes 212 opening along an axis generally parallel to the floor or surface 209 being coated, or having the first holes 212 along an axis perpendicular to squeegee 200, with a second hole or holes along axes perpendicular to the floor and parallel to the squeegee 200.

The holes 212 can have various shapes, including slots, but circular holes are preferred. Two holes 212 on the side of the tube, at about the midline of the tube 206, and one hole near on the end of the tube 206, are believed suitable. By locating holes 212 on the side of the tube 206, the material in the tube must reach the level of the holes 212 before flowing out the holes and thus flow control can be achieved using similar sized holes. But the number, location, size and shape of the holes 212 will vary with the material being coated, the pressure with which the coating material is provided, and the length and diameter of the tube 206, with the goal being to apply the material fairly uniformly to the surface 209 being coated so the coating 52 is substantially uniform so that each separate layer or coating 52 does not vary in average thickness by more than 50% per square inch over the majority of the surface 209. The same applies to the holes 208 in the manifold block 202. The ends of the tubes 206 are preferably plugged in order to force the coating material out the holes 212. The holes 212 and/or 208 comprise means for distributing a substantially uniform amount of mixed coating materials 26, 28 onto the surface to be coated.

Figure 14:
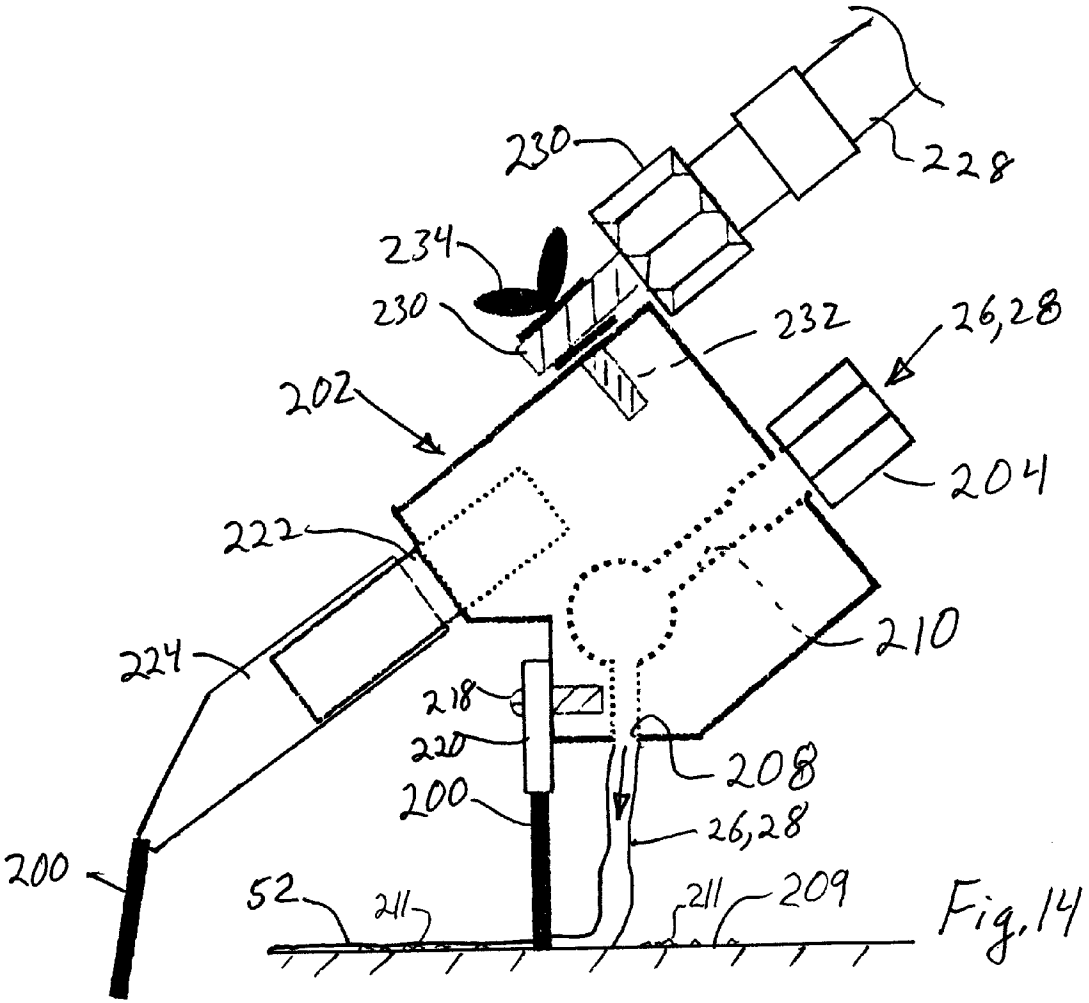
FIG. 14 is a cross sectional view of an applicator block showing two different attachment mechanisms for a squeegee and without any distribution tubes.
Figure 17:
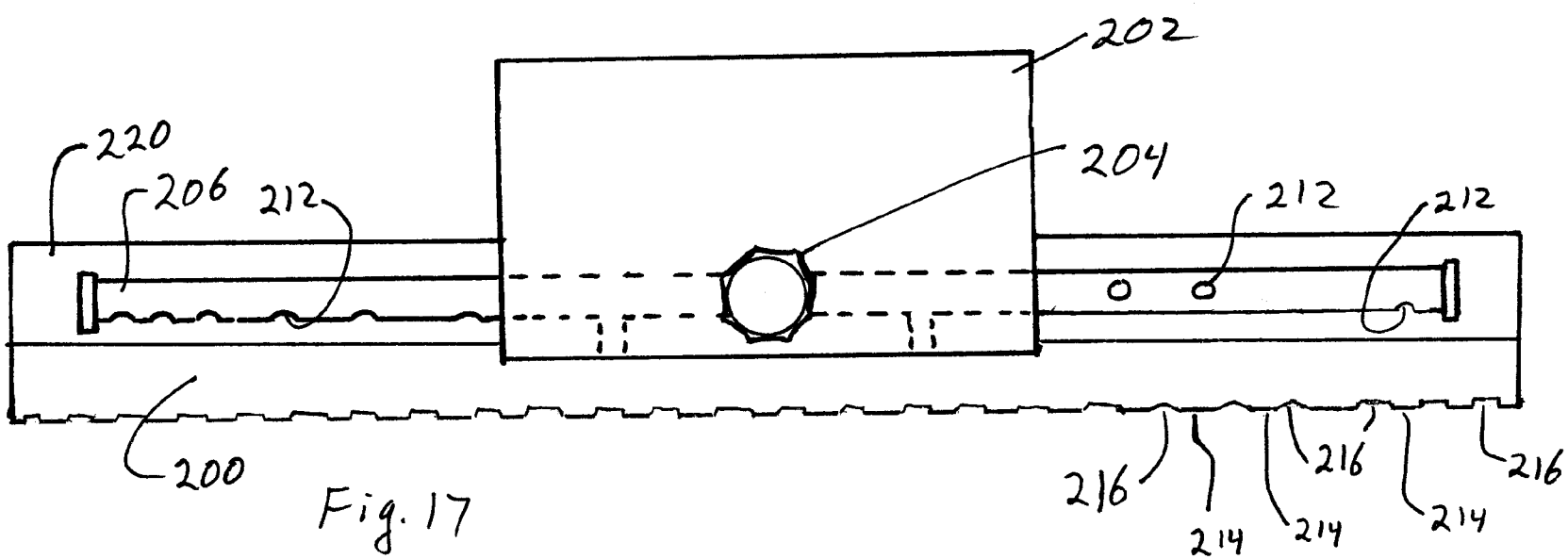
FIG. 17 is a view of a squeegee, distribution tube and applicator block.

The squeegee 200 spreads the mixed epoxy and resin 26, 28 on the surface 209 being coated. The squeegee 200 can be foam, metal, rubber, any suitable elastomers or any other suitable materials. Referring to FIGS. 14 and 17, the squeegee 200 preferably has an applicator edge that is straight or that has a plurality of ridges 214 and notches 216 so the coating material can flow through the notches 216 while the ridges 214 support the weight of the squeegee 200 on the surface 209 being coated. At a minimum, it is preferred to have ridges 214 at opposing ends with at least one notch therebetween. The notches 216 can be shallow, a few thousandths of an inch below the height of the adjacent ridge for most applications. For extremely thick coatings, deeper notches 216 can be used. The notches 216 can be square, rectangular, curved, triangular or other diverse shapes. Ideally, uniformly shaped and spaced ridges 214 separate uniformly shaped and spaced notches 216.

As seen in FIG. 14, the squeegee 200 can be mounted to the manifold block 202 in various ways. The lower depiction shows threaded fasteners such as bolts and screws 218 fastening the squeegee 200 to the manifold block 202. Depending on the stiffness of the squeegee 200, a stiffening bracket 220 may extend along the upper edge of the squeegee 200 in order to stiffen the squeegee, to hold the squeegee, and/or to reduce bending of the outer edges of the squeegee.

Figure 18:
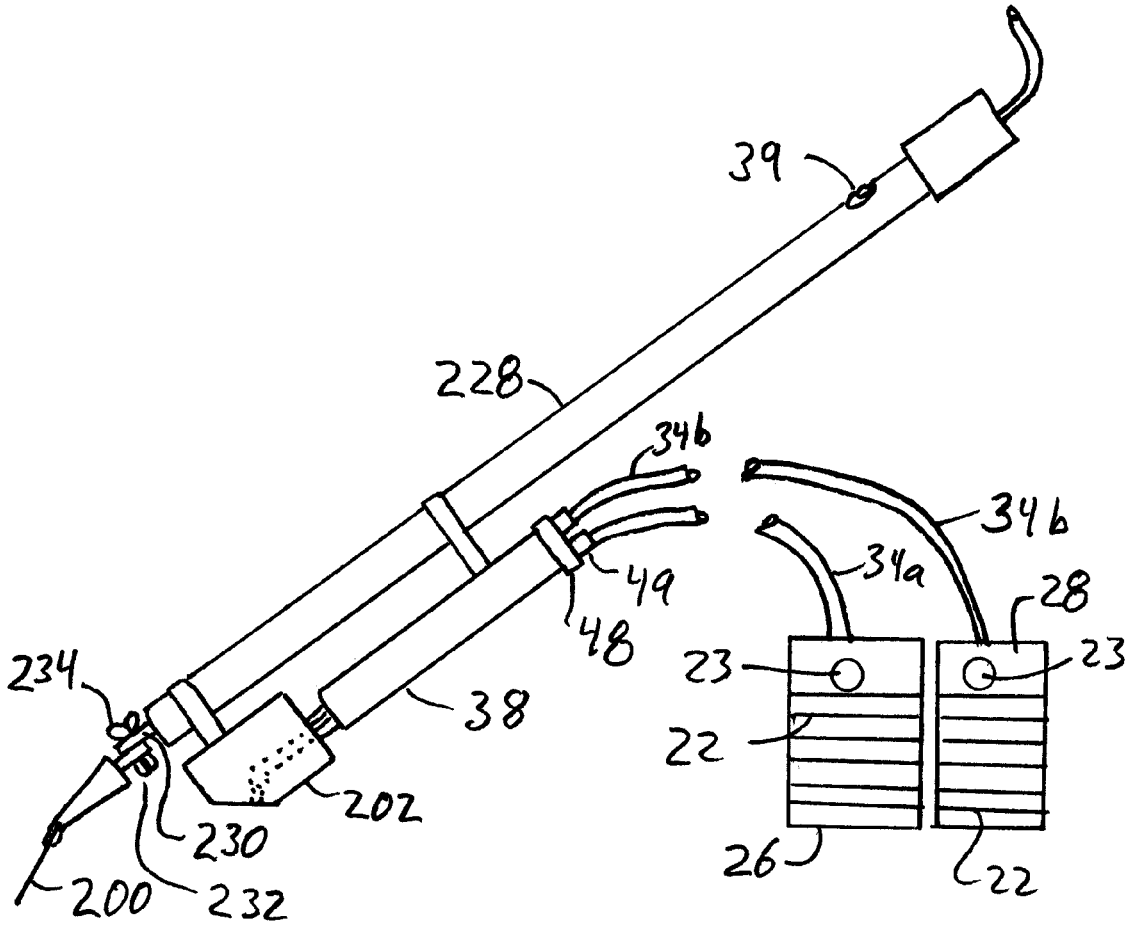
FIG. 18 is a side plan view of the squeegee fastened to the side of a handle.

FIG. 14 also shows a mounting connection 222, such as a post, to allow a re-attachable connection without using tools. The post extends from one end of the manifold block 202 and the squeegee has a connector 224 configured to releasably mate with the connector 222. Typically, a male connector such as a post 222 can extend from the manifold block 202 and a female connector can fit over the post to fasten the parts together. A threaded connection, bayonet connection, detent mechanism, or other releasable connections can be used to releasably connect the parts. FIGS. 18-19 show a swivel connection between the squeegee 200 and the end of the handle 228 that uses two overlapping parts held together by a fastener 232 extending through aligned holes in the two parts and clamped as desired to hold the parts in fixed relative positions or to allow rotation. Other connection mechanisms could also be used. The connections 222, 224 allow the squeegee 200 to extend beyond the manifold block 202 a few extra inches (2-6 inches) and that allows the mixed coating materials 26, 28 a little more time to spread out on the surface 209.

Figure 16:
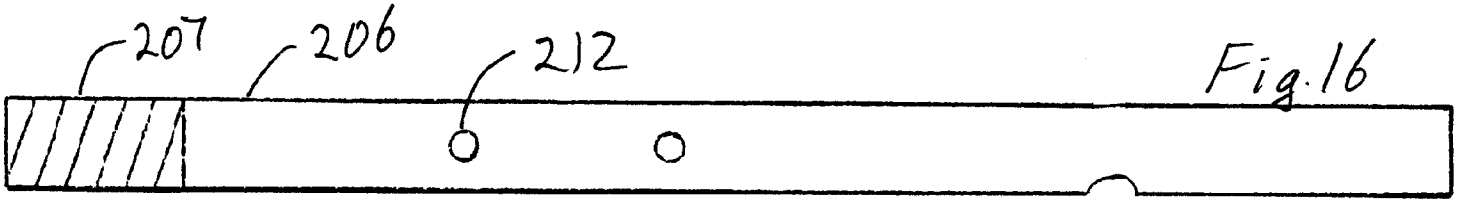
FIG. 16 is a side plan view of a distribution tube as used in FIG. 15.

Referring to FIGS. 16 and 19, preferred tubes 206 are about 6-8 inches long and will vary in diameter from ⅜ to ¾ inch, with a ½ inch diameter tube 206 being preferred. Three holes 212 are believed suitable, with the holes 212 spaced about 2, 3 and 4 inches from the edge of the manifold block 202, and with the holes about 3/16 inch in diameter. The first two holes 212 nearest the block 206 are thus parallel to each other and parallel to the floor 209, while the end hole 212 is oriented 90° to the first two holes and faces the floor 209.

Referring to FIGS. 14-15 and 18-19, the manifold block 202 is preferably fastened to a handle 228 so the user does not have to be so close to the floor or surface 209. The handle 228 is preferably connected to the squeegee 200 through a rotatable connection so the orientation of the squeegee 200 can be varied. Various adjustable mechanisms can be used. The end of the handle 228 preferably has a quick disconnect fitting, such as threads, detent mechanisms, or other known quick disconnect mechanisms that mates with a corresponding mechanism 230 fastened to the manifold block 202. The disconnect mechanism 230 also preferably, but optionally, has a swivel mechanism. One simple swivel mechanism places a hole through a side surface of the disconnect mechanism that is parallel with and overlaps a portion of the manifold block 202. A threaded fastener 232 extends through the hole and mechanism 230 and into the block 202 to releasably fasten the disconnect mechanism 230 to the block 202. By loosening tightening the fastener 232, as for example by a wrenching surface (not shown) or a wing nut 234 (shown), the orientation of the handle 228 relative to the manifold 202 and squeegee 200 can be adjustably varied, with the fastener 232 tightened to hold the desired orientation. In FIG. 14, the squeegee 200, manifold 202 and tubes 206 rotate together, in fixed relation to each other. As the manifold 202 rotates, the connection with the mixing tube 38 must allow the rotation, so a flexible tube or coupling is needed to connect to fitting 204 and sufficient space separates the tube 38 from the manifold 202 to allow whatever amount of rotation is provided. In FIG. 14, the squeegee 200 can rotate until the body of the quick disconnect mechanism 230 hits the block 202, but parts could be reconfigured to allow more rotation. In FIGS. 18-19, the squeegee 200 rotates separate from the manifold 202 and tubes 206.

Figure 5:
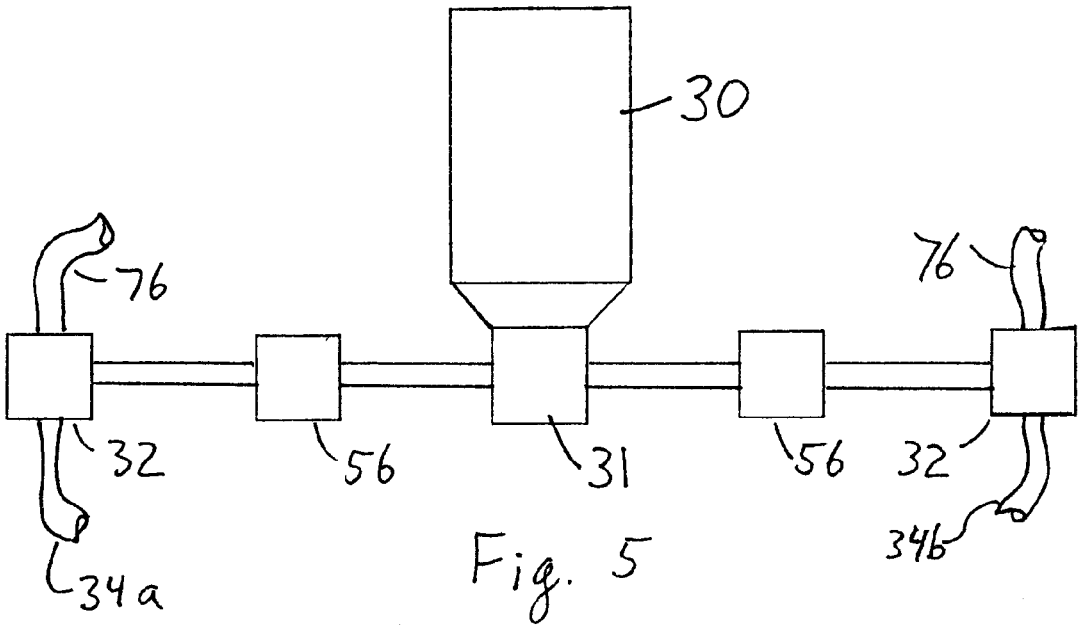
FIG. 5 is a schematic view of a pumping arrangement used in the roller system of FIG. 1.

As seen in FIGS. 20-21, the squeegee 200 is advantageously uses used with a smaller cart 20 having a lower cabinet portion enclosing the motor(s) 30 and pumps 32 (FIG. 21), with smaller containers 24 setting on top of the cart rather than being stored inside the cart. Stainless steel containers 26 of 2-3 gallon capacity are believed suitable, with hoses 76 connected to the containers 26 to pump fluids to the containers. For simplicity, the material recirculation can be omitted, but is preferably used. One or more motors 30 thus drive either a one or more peristaltic or gear pumps 32 or two independent pumps 32 to push the materials 26, 28 through lines 34*a*, 34*b* and through static mixing tube 38 and into manifold block 202, with the pumps controlled by switch 39 as described earlier. As described in FIGS. 9-10, a single peristaltic pump 32 can pump material through plural lines 34. As described regarding FIG. 5, advantageously a single pump 30 drives two pumps 32. Pressure gages 88 can monitor the pressure with regulators used to vary the pressure, or with temperature control of the materials 26, 28 used to vary the pressure, or with line heaters on the lines 34 being used to further reduce the pressure by heating the lines to make the materials 26, 28 more flowable and less viscous. To further simplify the system and reduce costs, the temperature gages 82 can be omitted, and an external temperature gage can be used. Mechanical or bulb type temperature readers are suitable, or laser temperature readers can be used read the temperature of the mixed materials 26, 28. The temperature can be read as the materials 26, 28 are dispensed from the squeegee 200, but preferably the lid of containers holding the materials 26, 28 is removed, the material is stirred, and the temperature read to get the temperature in the container 24. The static coil heaters 22 (FIG. 2) or heating pads on the tanks 26 and line heaters 35 wrapped around lines 34 can be used to make the materials more flowable by heating it within the lines and tanks. The line heaters 35 are not believed necessary until the ambient temperature is about 50° F. or lower. A wire tape with self regulating temperature and insulation are commercially available and are believed preferably for the line heater 35. The various heaters advantageously maintain the materials 26, 28 between 70° F. and 110° F., with the motor(s) 30 and pumps 32 pumping the materials at about 10 psi.

The mixing tube is fastened to a handle 42 or 228 which connects to the manifold block 202 or the roller assembly, depending on the desired use. The same handle 42, 228 can be used for both applicators (squeegee or roller), or a different handle can be used for each applicator, or extendable handles can be used. Each handle 42, 228 preferably has control switch 39, or other appropriate speed control switch either affixed to the handle or adjacent thereto. In the simplest configuration the switch 39 comprises an on-off switch that activates motor 30 to pump materials 26, 28 to and through the distribution block 202 at a constant rate. Alternatively, the switch 39 can vary the motor speed through any of various electronic and mechanical controls, including a variable speed switch.

In use, the materials 26, 28 are forced by pumps 32 through the lines 34 and mixer 38 into the manifold block 202 and through the parallel transfer pipes 206, which pipes are also preferably parallel to the squeegee 200. The switch 39 controls the flow of material to the squeegee 200 and can regulate the volume of material as needed by the user. The squeegee is drawn across the surface 209 towards the material that has been dispensed onto the surface from the block 202 and tubes 206. The squeegee 200 is typically drawn toward the user as the user backs away from the area previously coated on a floor. The squeegee 200 can be generally parallel to the distribution manifold 202 and tubes 206, or the squeegee 200 can be adjustably positioned relative to the block 202 and/or tubes 206. The configuration of FIGS. 19-20 allow the squeegee 200 to be positioned relative to the distribution block 202*n* and tubes 206 with the swivel connector at the end of the handle 228.

Instead of circulating the materials and maintaining them at a suitably elevated temperature to ensure flowability, the lines 34 can be flushed with a solvent suitable for the particular materials 26, 28 being used. To do so, the connection 49 (FIGS. 18-19) at the mixing tube 228 are preferably placed in fluid communication with the pumps 32 so the solvent circulates through the lines 34 after materials 26, 28 are flushed from the lines 34. Further, after flushing with solvent, the lines 34 can be filed with a neutralizer to keep the pumps and lines clean. A suitable neutralizer for use with epoxies is DIDP, diisodicyl phthylate. This material is also referred to as a plasticizer or polycizer, and is pumped through the lines 34 and pump until the lines are full. The lines 34 are drained of this solvent or of the neutralizer before use, and preferably the pump(s) 32 activated to clear the pump of neutralizer before use. While a sufficiently small amount of neutralizer is undesirable, it is tolerable in most applications, and the material can be pumped through the lines and out the applicator into a trash receptacle until a suitable quality of mixed materials 26, 28 is achieved.

There is also advantageously provided a method of coating surfaces, especially floors 209 with a coating 52. A user presses activation switch 39 which starts a motor that pumps materials 26, 28 through lines 34 through a mixing tube 38 in fluid communication with a manifold 202 that distributes the mixed materials onto the floor 209 through holes in the manifold 202 and laterally extending tubes 206. The manifold 202 and mixing tube 38 are both preferably fastened to the handle 228 so the user can manually manipulate the squeegee 200 which is also fastened to the handle or the manifold. The squeegee is preferably positionable relative to the handle longitudinal axis to allow flexibility in spreading materials with the squeegee.

By drawing the squeegee 200 over the mixed materials 26, 28 dispensed on the floor 229, a layered coating 52 can be spread on the floor 209. The squeegee 200 provides a smoother layering than other application methods, especially along the length of the squeegee. The squeegee 200 allows fast spreading of layered coating 52. The continual supply of mixed materials 26, 28 through lines 34 and controlled by switch 39 allows a fast application of the resin and activator 26, 28 so the squeegee 200 can smooth out the materials deposited on the surface 209 before the mixed materials 26, 28 cure enough that they cannot be smoothed out by the squeegee. A continuous supply of mixed materials 26, 28 is possible (at least within the volume limits of the containers 24 for the resin and activator) and the switch 39 allows selective interruption of that continuous supply.

After use, the switch 39 stops the flow of materials to the mixing tube 38, but mixed resin and activator 26, 28 are in the downstream portions of the application equipment, namely the mixing tube 38, the manifold 202, the tubes 206 and the squeegee 200. The mixing tube 38 can be cleaned with suitable solvents, or discarded and replaced. The manifold 206 and tubes 206 are preferably cleaned with suitable solvent. The fluid flow path from the connection with the mixing tube 38, through the connector 204, internal passageways 210 and tube 206 are accessible, and relatively short which makes for easier cleaning. If desired, the tubes 206 can be replaceable, but it is preferable that the manifold 206 be cleaned and reused. The squeegee 200 is readily accessible and can be wiped off and then wiped with a solvent impregnated rag for reuse. The tubes 76 (FIG. 21) from the tanks or containers 26 to the pumps 32 are short and are preferably discarded after the connection between the tubes 76 and containers 26 are sealed so the tanks 26 don't leak. As indicated above, the connection 49 (FIGS. 18-19) can be placed in fluid communication with the mixing tube 228 (FIGS. 18-19) and the inlet to the pumps 32 (FIG. 21) so that a suitable cleaning solvent can be used to flush the lines 34 and pumps 32. Thus, clean-up is easy and fast. If desired, all parts downstream of and including the mixing tube 38 can be replaced with each use or replaced intermittently as they become clogged with cured material and the replacement cost outweighs the cleaning cost. Likewise, referring to FIGS. 18-19 and 20-21, the short lines from the pump(s) 32 to the gauges 88 can be discarded and replaced.

Referring to FIG. 14, if the surface 209 being coated is smooth, then a squeegee 200 having notches 216 and ridges 214 is preferably used to control the thickness of the coating 52. The notches 216 are preferably close enough together that the mixed materials 26, 28 flow together after passage of the squeegee 200. If the surface 209 is rough or uneven then the surface is preferably coated with an adhesive which dries in 1-8 hours. An epoxy adhesive is typically used and is known in the art. The adhesive layer is applied with paint rollers dipped into trays, but could be applied using the roller 40 described herein. Chips 21 are broadcast onto the adhesive layer. The chips are typically ⅛ to ½ inch in size and of random shape. The chips are typically of vinyl or paper. The chips are preferably applied in a sufficient amount to provide a uniform support to the squeegee 200 and to prevent the squeegee from slipping down between the chips along the length of the squeegee. Thus, the squeegee 200 preferably rests on at least two chips 211 along the length of the squeegee as it is pulled across the surface 209 during use. The mixed materials 26, 28 are then dispensed from the manifold 202 and tubes 206 onto the floor 209 where the squeegee 200 is drawn (pulled or occasionally pushed) over the surface and chips 211 to smooth out the coating materials 26, 28. The mixed materials are preferably deposited onto the surface 209 adjacent the squeegee, preferably a few inches from the squeegee 200. The mixed materials 26, 28 are preferably deposited onto the surface 209 parallel to the squeegee 200 when the tubes 206 are aligned with a length of the squeegee, but relative rotation of the squeegee and tubes are allowed so the materials could be deposited along a line inclined at an angle to the squeegee. Of course, if there are more than two materials 26, 28, they are likewise mixed and spread by the squeegee.

For smooth surfaces the squeegee 200 is not only preferably notched, but it is preferably made of a hard rubber or elastomeric material. For surfaces 209 having a plurality of chips 211, the squeegee 200 is preferably of a softer material, preferably a foam rubber of foam elastomeric material. The harder material causes the squeegee to chatter as it is drawn across the chips 211.

After the coating 52 is applied by the squeegee 200, the surface is preferably back rolled using paint rollers and long extension handles. The surface 52 coated by squeegee 200 is preferably back rolled in the opposite direction in which the squeegee 200 is drawn, and is rolled in order to smooth out irregularities. The coating 52 is preferably rolled about 4-8 feet in front of the squeegee.

Depending on the surface being coated, and whether it is a floor or walls, the thickness of the materials 26, 28 can be varied to help the squeegee 200 leave a smooth surface. Further, if the surface 209 being coated has recesses or depressions additional material can be applied by selectively activating the switch 39 and spreading the mixed resin and activator. Applying heat to the lines 34 can also make the mixed materials 26, 28 more flowable and less viscous so that any ridges or streaks or seams left from the notches 214 or from overlapping applications of the squeegee, all flow together to form a more uniform coating 52. Heaters 22 (FIG. 18) on separate tanks 26 can be controlled by thermostats 23 (FIG. 18) to help maintain the fluid flow as needed. The heaters 22 can be wrapped around the tanks or containers 26, or heating pads can be used with the tanks placed on the heating pads and built in thermostats 22 can be used with the pad heaters. If the tanks are separately heated by resistance heaters then an enclosed cart is not necessary and the tanks 26 can be placed on a wheeled platform, with the pump 32 and motor 30 thereon, and arranged in various driving and pumping configurations.

For the smaller cart 20 of FIGS. 20-21, it is believed suitable to use a smaller motor, preferably a ¼ hp motor or smaller. DC motors of 12V power and operating at about 200 RPM or less are believed suitable when one or more peristaltic motors 30 are used to force materials 26, 28 through the lines 34. A 24V, 1/13 hp motor 30 operating at about 100 RPM to drive two pumps 32 is also believed suitable, as are other motors of about ¼ hp or smaller. The low ramp motors described earlier are not believed necessary with the smaller cart 20 of FIGS. 20-21 and the squeegee 200. The use of smaller motors reduces power consumption and allows the use of lighter and smaller components. The low voltage motors require a voltage transformer from the typical 110V or 220V line voltage. Such transformers are commonly used with laptop computers and are readily available.

Further, the handle 228 and mixing tube 38 can be removed from connector 204 and manifold 202 and connected to the roller applicator discussed above, thus providing multiple ways of applying the coating materials. The material dispensing openings 208 in the manifold 202 can be omitted if the manifold is made small enough or if the tubes 206 are configured to have openings 212 to provide mixed coating material along the entire length of the squeegee 200, as for example by having a single tube 206 below, in front of or behind the manifold 202. As used herein, forward refers to a direction from the manifold 202 toward the squeegee 200 and parallel to the floor 209, with backward being the opposite direction, and lateral being perpendicular thereto but parallel to the floor 209. If the surface 209 being coated is not a floor, one skilled in the art will be able to figure out the relative directions accordingly.

The foregoing is considered as illustrative only of the principles of the invention. Furthermore, since numerous modifications and changes will readily occur to those skilled in the art, it is not desired to limit the invention to the exact construction and operation shown and descried. The above description is thus given by way of example, and not limitation. Given the above disclosure, one skilled in the art could devise variations that are within the scope and spirit of the invention. The various features of this invention can be used alone, or in varying combinations with each other and are not intended to be limited to the specific combination described herein

What is claimed is:

1. A squeegee apparatus for use in applying a coating material to a surface, comprising:

an elongated squeegee having a length, the squeegee being sized and configured to spread a premixed mixture of resin and activator before the mixture cures too much to be spread by the squeegee;

a manifold having a fitting connecting in fluid communication to a mixing tube configured to mix a resin and activator, the manifold having sides and being in fluid communication with a distribution tube extending beyond each side, the distribution tube having plural openings to dispense material onto the surface being coated during use, the tube being aligned with the squeegee; and a hand carried, elongated handle connected to one of the manifold and squeegee for manual positioning of the squeegee relative to the surface being coated.

2. The apparatus of claim 1, wherein there are two distribution tubes each releasably fastened to one of an opposing side of the manifold and wherein the manifold has openings in fluid communication with the distribution tubes so the manifold openings can dispense material during use.

3. The apparatus of claim 1, wherein a swivel connection connects the handle to the manifold so the manifold can rotate in a plane parallel to the surface being coated during use.

4. The apparatus of claim 1, wherein the squeegee is releasably fastened to a post on the manifold.

5. The apparatus of claim 1, wherein a plurality of the openings in the distribution tubes open along an axis parallel to a plane containing the squeegee and a plurality of the openings in the distribution tubes open along an axis orthogonal to that plane.

6. The apparatus of claim 1, wherein the squeegee has an edge for spreading the material during use, and wherein said edge is straight.

7. The apparatus of claim 1, wherein the squeegee has an edge for spreading the material during use, and said edge has a plurality of ridges and notches.

8. The apparatus of claim 1, further comprising a stiffening bracket extending along a length of the squeegee to stiffen the squeegee.

9. The apparatus of claim 1, wherein a threaded fastener extends from the manifold and the end of the handle has an opening through which the threaded fastener passes to rotatably connect the squeegee to the handle to rotate about the fastener, the threaded fastener and squeegee being configured to allow the squeegee to be held in different selected orientations relative to the handle.

10. The apparatus of claim 1, further comprising a swivel connection connecting the handle to the manifold so the manifold can rotate in a plane parallel to the surface being coated during use, with the squeegee fastened to the manifold in a fixed position so the squeegee and manifold can swivel together.

11. The apparatus of claim 1, wherein the squeegee is rotatably connected to the handle so it can rotate in a plane parallel to the surface being coated during use.

12. The apparatus of claim 1, wherein the manifold and mixing tube are connected to an end of the handle.

13. The apparatus of claim 1, wherein a disconnect mechanism is interposed between the handle and the squeegee so the squeegee can be removed from the handle.

14. The apparatus of claim 13, wherein the disconnect mechanism has a swivel connection which allows rotation parallel to the surface being coated during use.

15. The apparatus of claim 1, further comprising a flexible tube connecting the mixing tube to the manifold.

16. The apparatus of claim 1, wherein the manifold is removably attached to one of the squeegee or handle and the distribution tubes are removably attached to the manifold.

17. A squeegee apparatus for coating mixed materials on a surface in combination with a source of pressurized activator and resin in fluid communication with a mixing tube having an outlet, comprising:

a manifold in fluid communication with the outlet of the mixing tube, at least one distribution tube having a length with a plurality of holes to dispense the mixed materials during use and in fluid communication with the outlet of the mixing tube, the distribution tube being fastened to the manifold;

an elongated squeegee fastened to the manifold and having an edge configured to spread the mixed materials during use, the distribution tube and the squeegee edge being aligned along substantially parallel axes and held in fixed relationship to each other by the manifold; and a hand carried, elongated handle connected to one of the manifold and squeegee for manual positioning of the squeegee relative to the surface being coated.

18. The squeegee apparatus of claim 17, wherein the handle has an electrical switch accessible from the handle by a user's hand holding the handle during use, the switch being electrically wired to activate the source of pressurized activator and resin during use.

19. The squeegee apparatus of claim 18, further comprising a swivel connection connecting the handle and manifold, the swivel connection allowing manifold to rotate in a plane parallel to the surface being coated during use.

20. The squeegee apparatus of claim 17, further comprising holes in the manifold in fluid communication with the outlet of the mixing tube during use, the holes in the manifold located to dispense material directly onto the surface being coated during use.

21. The squeegee apparatus of claim 17, further comprising a releasable connection on the squeegee cooperating with a mating part on the manifold to releasably fasten the squeegee to the manifold.

22. The squeegee apparatus of claim 17, wherein the source of pressurized activator and resin comprise 12V or 24V DC electric motors of under ¼ hp each.

23. The apparatus of claim 17, wherein the squeegee has an edge for spreading the material during use, and wherein said edge is straight.

24. The apparatus of claim 17, wherein the squeegee has an edge for spreading the material during use, and said edge has a plurality of ridges and notches.

25. The apparatus of claim 17, further comprising a stiffening bracket extending along a length of the squeegee to stiffen the squeegee.

26. The apparatus of claim 17, wherein a disconnect mechanism is interposed between the handle and the squeegee so the squeegee can be removed from the handle.

27. The apparatus of claim 17, wherein the handle is removably attached to the squeegee and the distribution tubes are removably attached to the manifold.

28. The apparatus of claim 17, wherein the handle is removably attached to the manifold.

29. A squeegee apparatus for use in applying a coating material to a surface, comprising:

an elongated squeegee having a length, the squeegee being sized and configured to spread a premixed mixture of resin and activator before the mixture cures too much to be spread by the squeegee;

a manifold having a fitting adapted to connect to a mixing tube that mixes a resin and activator, the manifold having sides and being in fluid communication with a distribution tube extending beyond each side, the distribution tube having plural openings to dispense material onto the surface being coated during use, the tube being aligned with the squeegee; and a handle connected to one of the manifold and squeegee;

wherein a plurality of the openings in the distribution tubes open along an axis parallel to a plane containing the squeegee and a plurality of the openings in the distribution tubes open along an axis orthogonal to that plane.

* * * * *